US005524598A

United States Patent [19]

Hasegawa et al.

[11] Patent Number: 5,524,598

[45] Date of Patent: Jun. 11, 1996

[54] METHOD FOR DETECTING AND CONTROLLING AIR-FUEL RATIO IN INTERNAL COMBUSTION ENGINE

[75] Inventors: Yusuke Hasegawa; Eisuke Kimura; Shusuke Akazaki; Isao Komoriya; Toshiaki Hirota, all of Saitama, Japan

[73] Assignee: Honda Giken Kogyo Kabushiki Kaisha, Tokyo, Japan

[21] Appl. No.: 282,104

[22] Filed: Jul. 28, 1994

Related U.S. Application Data

[63] Continuation of Ser. No. 997,769, Dec. 24, 1992.

[30] Foreign Application Priority Data

| | | | |
|---|---|---|---|
| Dec. 27, 1991 | [JP] | Japan | 3-359338 |
| Dec. 27, 1991 | [JP] | Japan | 3-359339 |
| Dec. 27, 1991 | [JP] | Japan | 3-359340 |

[51] Int. Cl.[6] ..... F02M 51/00

[52] U.S. Cl. ..... 123/672

[58] Field of Search ..... 123/672, 674, 123/480, 676, 695, 688; 364/431.10, 431.06, 431.05; 60/272

[56] References Cited

U.S. PATENT DOCUMENTS

| | | | |
|---|---|---|---|
| 4,377,143 | 3/1983 | Hamburg | 123/672 |
| 4,785,780 | 11/1988 | Kawai | 123/339 |
| 4,870,586 | 9/1989 | Asakura et al. | 364/431.06 |
| 4,980,834 | 12/1990 | Ikeda et al. | 364/431.05 |
| 5,121,732 | 6/1992 | Benninger et al. | 123/672 |
| 5,148,369 | 9/1992 | Uchinami et al. | 364/431.06 |
| 5,158,063 | 10/1992 | Hosoda et al. | 123/676 |
| 5,163,407 | 11/1992 | Yoshida et al. | 123/672 |
| 5,199,408 | 4/1993 | Wataya | 123/672 |
| 5,222,471 | 6/1993 | Stueven | 123/695 |
| 5,243,954 | 9/1993 | Moss | 123/688 |
| 5,255,662 | 10/1993 | Nakajima | 123/674 |
| 5,284,118 | 2/1994 | Kato et al. | 123/688 |
| 5,327,876 | 7/1994 | Uchida | 123/688 |

FOREIGN PATENT DOCUMENTS

| | | | |
|---|---|---|---|
| 134547 | 2/1985 | European Pat. Off. | 123/672 |
| 345814 | 12/1989 | European Pat. Off. | 123/672 |
| 352705 | 2/1990 | European Pat. Off. | 123/672 |
| 59-101562 | 6/1984 | Japan | 123/672 |
| 4369471 | 4/1992 | Japan | 123/672 |

OTHER PUBLICATIONS

Proceeding of the 1990 American Control Conference, 25 May 1990, San Diego, CA. pp. 2881–2886 "Individual Cylinder Air–Fuel Ratio Control with a snigle EGO Sensor".

Abstract of JP 3149330.

Abstract of JP 1110853.

European Search Report.

Brief explanation of publication 4–369471 (English translation).

English translation of Abstract of JP 59–101562.

Fortmann and Hitz, *An Introduction to Linear Control Systems*, Chapter 12, Marcel Dekler, Inc., 1977.

*Primary Examiner*—Raymond A. Nelli
*Attorney, Agent, or Firm*—Lyon & Lyon

[57] ABSTRACT

A method for detecting and controlling the air-fuel ratio of a multicylinder internal combustion engine through an output of a single air-fuel ratio sensor installed at a confluence point of the exhaust system of the engine. The detection response delay is assumed to be a first-order lag and a state variable model is established. Further, the air-fuel ratio at the confluence point is assumed to be a sum of the products of the past firing histories of the each cylinder of the engine and a second state variable model is established. An observer is then designed to observe the internal state of the second model and the air-fuel ratio at the individual cylinders are estimated from the output of the observer. The deadbeat control is carried out by calculating a ratio between the estimated air-fuel ratio and a target air-fuel ratio. The calculated ratio is multiplied to a correction value at a preceding control cycle earlier by a number corresponding to the number of the engine cylinders.

27 Claims, 35 Drawing Sheets

42
CPU
50
ROM
52
RAM
54
Driver
68
Driver
66
Solenoid valve
70
Injector
20
A/D
48
A/D
60
Detection circuit
46
Multiplexer
58
Level converter
56
Counter
64
Pulse generator
62
Air-fuel ratio sensor
40
Throttle position sensor
36
Manifold absolute pressure sensor
38
Crank-angle sensor
34

FIG. 14

Gain matrix K

| | Member of Q : Member of R | | |
|---|---|---|---|
| | 1 : 10 | 1 : 1 | 10 : 1 |
| K | $\begin{pmatrix} -0.1122 \\ 0.5214 \\ 0.1122 \\ 0.0242 \end{pmatrix}$ | $\begin{pmatrix} -0.3093 \\ 1.1918 \\ 0.3093 \\ 0.0803 \end{pmatrix}$ | $\begin{pmatrix} -0.5709 \\ 1.7594 \\ 0.5709 \\ 0.1852 \end{pmatrix}$ |

FIG. 17

Error of observer's estimation
( Q : R = 10 : 1 (e) )

| | Target air-fuel ratio | Estimated air-fuel ratio | Error |
|---|---|---|---|
| After 4 TDC | 14.7 | 14.4634 | 1.603 % |
| After 8 TDC | 14.7 | 14.6475 | 0.357 % |
| After 12 TDC | 14.7 | 14.6842 | 0.107 % |
| Average for 0~8 sec | | | 0.772 % |

FIG. 19

Error of observer's estimation
( Q : R = 10 : 1 (e) )

| | Target air-fuel ratio | Estimated air-fuel ratio | Error |
|---|---|---|---|
| After 4 TDC | 14.8167 | 14.4648 | 2.375 % |
| After 8 TDC | 14.8989 | 14.7674 | 0.883 % |
| After 12 TDC | 14.8486 | 14.8452 | 0.023 % |
| Average for 0~8 sec | | | 1.771 % |

FIG. 46

Error ( Q : R = 10 : 1 (c) )

| | Target air-fuel ratio | Result | Error |
|---|---|---|---|
| After 5 TDC | 14.7 | 12.000 | 18.367 % |
| After 9 TDC | 14.7 | 14.400 | 2.041 % |
| After 13 TDC | 14.7 | 14.594 | 0.721 % |
| Average for 0~8 sec | 14.7 | | 1.333 % |

FIG. 47

Error ( Q : R = 10 : 1 (c) )

| | Target air-fuel ratio | Result | Error |
|---|---|---|---|
| After 5 TDC | 14.7 | 12.118 | 17.565 % |
| After 9 TDC | 14.7 | 14.166 | 3.633 % |
| After 13 TDC | 14.7 | 14.686 | 0.095 % |
| Average for 0~8 sec | 14.7 | | 2.284 % |

METHOD FOR DETECTING AND CONTROLLING AIR-FUEL RATIO IN INTERNAL COMBUSTION ENGINE

This application is a continuation-in-part application of application Ser. No. 07/997,769, filed on Dec. 24, 1992.

BACKGROUND OF THE INVENTION

1. Field of the Invention

This invention relates to a method for detecting and controlling the air-fuel ratio in an internal combustion engine, more particularly to a method for detecting the air-fuel ratio in a multiple cylinder internal combustion engine accurately and controlling to a target air-fuel ratio with good convergence.

2. Description of the Prior Art

It is a common practice to install a single air-fuel ratio sensor constituted as an oxygen concentration detector in the exhaust system of a multiple cylinder internal combustion engine and feedback the detected value for regulating the amount of fuel supplied to a target air-fuel ratio. A system of this type is taught by Japanese Patent Publication No. Sho 59(1984)-101562, for example.

In the system, in order to improve the detection accuracy, a time lag counted from a reference timing (a first cylinder's TDC position) and required for the exhaust gas flowing out of the individual cylinders to reach the air-fuel ratio sensor is predetermined in advance in response to the operating condition of the engine. And taking the predetermined time lag into consideration, the air-fuel ratio is detected for the individual cylinders and is feedback controlled to a target value. However, since the air-fuel ratio sensor constituted as an oxygen detector is arranged to detect the air-fuel ratio through a generated electromotive force caused by a chemical reaction which occurs when an element of the oxygen detector comes into contact with the exhaust gas, the sensor can not respond immediately and there is a delay in detecting the air-fuel ratio after the exhaust gas has reached the sensor. This means that, until the delay has been solved, the air-fuel ratio of the burnt mixture could not be detected precisely and hence the accurately and excellent convergence could not be expected in the air-fuel ratio feedback control.

SUMMARY OF THE INVENTION

An object of the invention is therefore to provide a method for detecting the air-fuel ratio in an internal combustion engine in which the detection response lag in the air-fuel ratio sensor is precisely estimated to accurately obtain the air-fuel ratio of the mixture actually burnt such that the air-fuel ratio feedback control can, if desired, be conducted in a manner excellent in accuracy and convergence.

Further, when a single air-fuel ratio sensor is installed at or downstream of an confluence point (the exhaust manifold joint) of a multicylinder engine such as having four or six cylinders, the output of the sensor represents a mixture of the values at all cylinders. This makes it hard to obtain the actual air-fuel ratio at the individual cylinders and then makes it difficult to converge it to a target ratio properly. Thus, some cylinders could be supplied with a lean mixture whereas others a rich mixture, thereby degrading emission characteristics.

Although this can be solved by providing the sensor for the individual cylinders, the arrangement will necessarily be expensive and what is more, brings another problem on sensor's service life. For, it is not advantageous to install many air-fuel ratio sensors in the exhaust system to suffer them from a hot ambient temperature. The prior art system aimed to solve the problem. However, since the air-fuel ratio at the confluence point of the exhaust system is a mixture of those at the individual cylinders as was explained, the prior art system leaves much to be improved, such as in its detection accuracy.

Another object of the invention is therefore to provide a method for estimating the air-fuel ratio in a multicylinder internal combustion engine in which the air-fuel ratios of the individual cylinders are precisely estimated from the output of a single air-fuel ratio sensor installed at or downstream of an exhaust gas confluence point in the exhaust system of the engine.

Further object of the invention is to provide a similar method for estimating the air-fuel ratio in a multicylinder internal combustion engine in which the air-fuel ratio of each cylinder is precisely estimated from the output of a single air-fuel ratio sensor installed at or downstream of an exhaust gas confluence point in the exhaust system of the engine such that the air-fuel ratios at the individual cylinders are feedback controlled to a target ratio in a manner excellent in accuracy and convergence.

Furthermore, in the air-fuel ratio control, the air-fuel ratios at the individual cylinders are usually PID-controlled based on their deviation from the target value. With this method, however, the convergence on the target values is often less than satisfactory. This is because cost and durability considerations normally make it impossible to install a plurality of air-fuel ratio sensors for detecting the air-fuel ratios at the individual cylinders, as stated before. The air-fuel ratios at the individual cylinders therefore have to be estimated from the output of a single sensor installed in the exhaust system. Since this makes it impossible to ascertain the air-fuel ratios at the individual cylinders with high precision, the feedback gain has to be kept down in order to prevent hunting. The control convergence is therefore not so satisfactory than expected.

Still further object of the invention is therefore to provide a method for controlling the air-fuel ratio in a multicylinder internal combustion engine wherein the air-fuel ratios at the individual cylinders of the engine can be accurately separated and extracted from the output of a single air-fuel ratio sensor installed at or downstream of an exhaust gas confluence point of the exhaust system and the so-obtained air-fuel ratios can be used for conducting the control, what is called the "deadbeat control", for immediately converging the air-fuel ratio at each cylinder to the target ratio with deadbeat response.

A technique to immediately converge the air-fuel ratio to the target air-fuel ratio is in no ways limited to the multicylinder engine in which a single air-fuel ratio sensor is used.

Yet still further object of the invention is therefore to provide a method for controlling the air-fuel ratio in an internal combustion engine which is more generally applicable even to an arrangement in which the air-fuel ratios are detected by sensors installed at the individual cylinders, wherein the deadbeat control is conducted for immediately converging the air-fuel ratio at each cylinder on the target air-fuel ratio during the next control cycle.

For realizing these objects, the present invention provides a method for detecting the air-fuel ratio of a mixture supplied to an internal combustion engine through an output of an air-fuel ratio sensor, comprising deeming a detection response lag of the sensor as a first-order lag to establish a state variable model, obtaining a state equation describing the behavior of the state variable model, discretizing the state equation for period delta T to obtain a transfer function, and obtaining an inverse transfer function of the transfer function and multiplying it to the output of the sensor to estimate the air-fuel ratio of the mixture supplied to the engine.

BRIEF DESCRIPTION OF THE DRAWINGS

These and other objects and advantages of the invention will be more apparent from the following description and drawings, in which:

FIG. 2A is a simplified flow chart of the control unit of FIG. 2;

FIG. 14 is a table showing the gain matrix of the model of FIG. 8 obtained by varying the ratio between the members of Q and R;

FIG. 17 is a table showing the error between the target air-fuel ratio and the estimated ratio in the simulation result of FIG. 16;

FIG. 19 is a table, similar to FIG. 17, but showing the similar error in the simulation result of FIG. 18;

FIGS. 46 and 47 are tables showing the errors in the simulation of FIGS. 44 and 45.

DETAILED DESCRIPTION OF THE PREFERRED EMBODIMENTS

Figure 1:
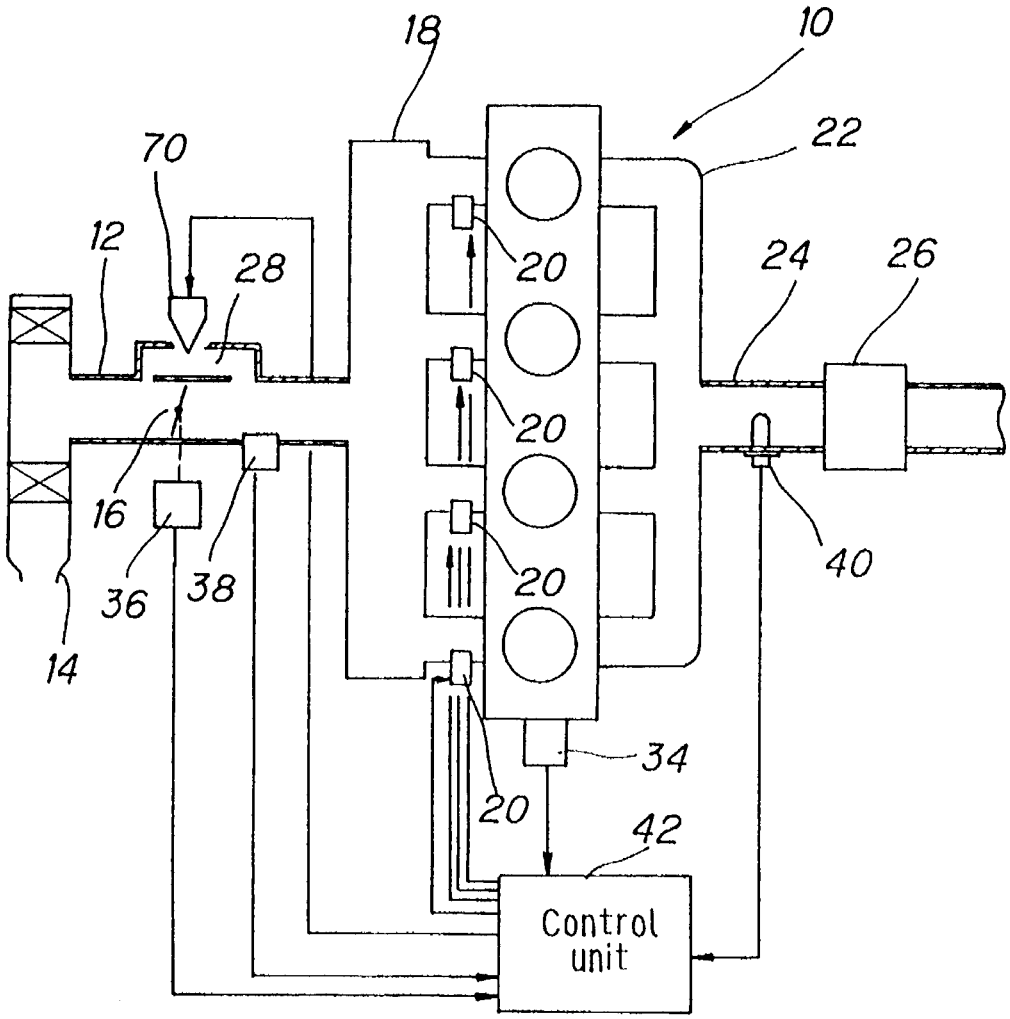
FIG. 1 is an overall schematic view of an internal combustion engine air-fuel detection and control system, in hardware construction, for carrying out the method of the present invention.

FIG. 1 is an overall schematic view of an internal combustion engine air-fuel ratio detection and control system, in hardware construction, for carrying out the method of this invention. Reference numeral 10 in this figure designates an internal combustion engine having four cylinders. Air drawn in through an air cleaner 14 mounted on the far end of an air intake path 12 is supplied to first to fourth cylinders through an air intake manifold 18 while the flow thereof is adjusted by a throttle valve 16. An injector 20 for injecting fuel is installed in the vicinity of the intake valve (not shown) of each cylinder. As is well known, the amount of fuel injected by each injector 20 for each intake stroke of the associated piston in a cylinder is controlled by control unit 42 and may be varied from cylinder-to-cylinder and stroke-by-stroke. The injected fuel mixes with the intake air to form an air-fuel mixture that is ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 22, from where it passes through an exhaust pipe 24 to a three-way catalytic converter 26 where it is removed of noxious components before being discharged to the exterior. In addition, the air intake path 12 is bypassed by a bypass 28 provided therein in the vicinity of the throttle valve 16.

A crank-angle sensor 34 for detecting the piston crank angles is provided in a distributor (not shown) of the internal combustion engine 10, a throttle position sensor 36 is provided for detecting the degree of opening of the throttle valve 16, and a manifold absolute pressure sensor 38 is provided for detecting the pressure of the intake air downstream of the throttle valve 16 as an absolute pressure. An air-fuel ratio sensor 40 constituted as an oxygen concentration detector is provided at the exhaust pipe 24 in the exhaust system at a point downstream of the exhaust manifold 22 and upstream of the three-way catalytic converter 26, where it detects the air-fuel ratio of the exhaust gas. The outputs of these sensors are sent to a control unit 42.

Figure 2:
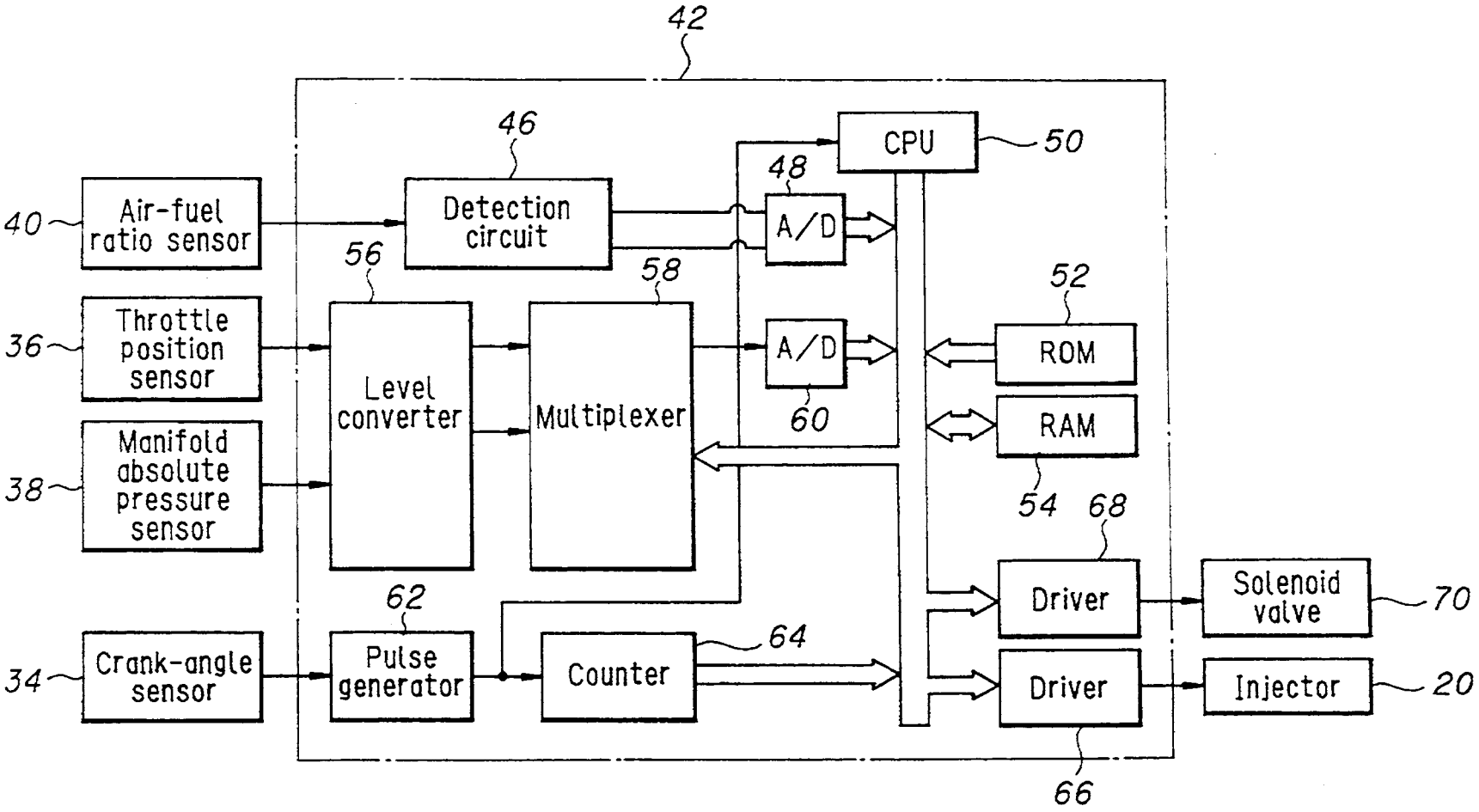
FIG. 2 is a block diagram showing the details of the control unit illustrated in FIG. 1.

Details of the control unit 42 are shown in the block diagram of FIG. 2. The output of the air-fuel ratio sensor 40 is received by a detection circuit 46 of the control unit 42, where it is subjected to appropriate linearization processing to obtain an air-fuel ratio (A/F) characterized in that it varies linearly with the oxygen concentration of the exhaust gas over a broad range extending from the lean side to the rich side. As this air-fuel ratio is explained in detail in the applicant's earlier Japanese patent application (Japanese Patent Application No. Hei 3(1991)-169456), it will not be explained further here. Hereinafter in this explanation, the air-fuel ratio sensor will be referred to as an "LAF sensor" (the name is derived from its characteristics in which the air-fuel ratio can be detected linearly). The output of the detection circuit 46 is forwarded through an A/D (analog/digital) converter 48 to a microcomputer comprising a CPU (central processing unit) 50, a ROM (read-only memory) 52 and a RAM (random access memory) 54 and is stored in the RAM 54. Similarly, the analog outputs of the throttle position sensor 36 and the manifold absolute pressure sensor 38 are input to the microcomputer through a level converter 56, a multiplexer 58 and a second A/D converter 60, while the output of the crank-angle sensor 34 is shaped by a pulse generator 62 and has its output value counted by a counter 64, the result of the count being input to the microcomputer. In accordance with commands stored in the ROM 52, the CPU 50 of the microcomputer uses the detected values to compute an air-fuel ratio feedback control value, drives the injectors 20 of the respective cylinders via a driver 66 and drives a solenoid valve 70 via a second driver 68 for controlling the amount of secondary air passing through the bypass 28.

The operation of this control system will now be explained.

For high-accuracy separation and extraction of the air-fuel ratios of the individual cylinders from the output of a single air-fuel ratio sensor installed at or downstream of an exhaust gas confluence point in the exhaust system of a multiple cylinder engine, it is first necessary to accurately ascertain the detection response delay of the air-fuel ratio sensor. The solid line curve in FIG. 3, the figure being the result of simulation which will be explained at a later stage, shows the air-fuel ratio sensor response carried out in a one-cylinder internal combustion engine when the amount of intake air was presumed to be maintained constant and the amount of fuel supplied was presumed to be varied stepwise as illustrated by dashed lines. As can be seen in this figure, when the air-fuel ratio is varied stepwise, the LAF sensor output lags behind the input value. Since this lag is caused by a chemical reaction as was mentioned earlier, however, it is difficult to analyze precisely. The inventors therefore used simulation to model this delay as a first-order lag. For this they built the model shown in FIG. 4. Here, if we define LAF: LAF sensor output and A/F: input air-fuel ratio, the state equation can be written as $$\dot{LAF}(t) = \alpha LAF(t) + \alpha A/F(t) \quad (1)$$

When the state equation is discretized in the discrete-time series for period delta T, we get $$LAF(k+1) = \hat{\alpha} LAF(k) + (1-\hat{\alpha}) A/F(k) \quad (2)$$

Here:

$$\hat{\alpha} = 1 + \alpha\Delta T + (1/2!)\alpha^2\Delta T^2 + (1/3!)\alpha^3\Delta T^3 + (1/4!)\alpha^4\Delta T^4$$

Figure 5:
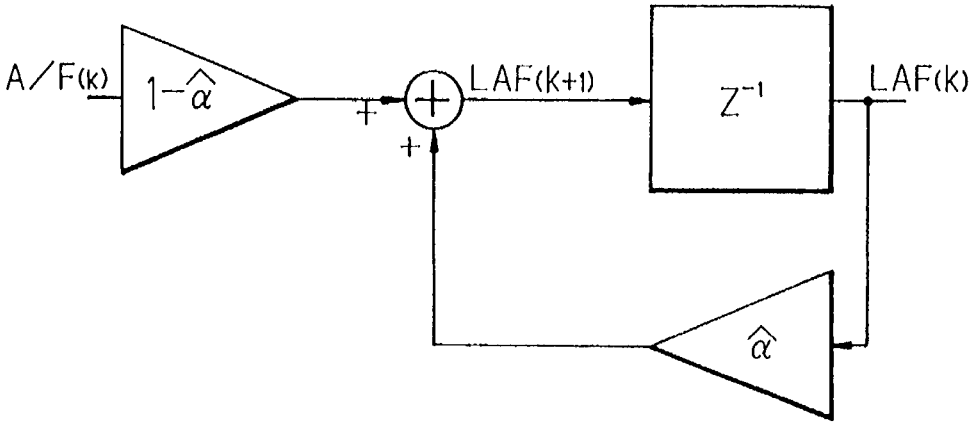
FIG. 5 is a block diagram showing the model of FIG. 4 discretized in the discrete-time series for period delta T.

Equation (2) is represented as a block diagram in FIG. 5.

Therefore, Equation (2) can be used to obtain the actual air-fuel ratio from the sensor output. That is to say, since Equation (2) can be rewritten as Equation (3), the value at time k+1 can be calculated back from the value at time k as shown by Equation (4).

$$A/F(k) = \{LAF(k+1) - \hat{\alpha} LAF(k)\}/(1-\hat{\alpha}) \quad (3)$$

$$A/F(k-1) = \{LAF(k) - \hat{\alpha} LAF(k-1)\}/(1-\hat{\alpha}) \quad (4)$$

Figure 6:
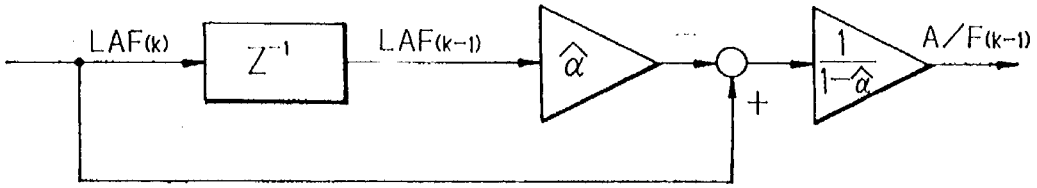
FIG. 6 is a block diagram showing a real-time air-fuel ratio estimator according to the present invention based on the model of FIG. 5.

Specifically, use of Z transformation to express Equation (2) as a transfer function gives Equation (5), and a real-time estimate of the air-fuel ratio in the preceding cycle can be thus obtained by multiplying the sensor output LAF of the current cycle by its inverse transfer function. FIG. 6 is a block diagram of the real-time A/F estimator.

$$t(z) = (1-\hat{\alpha}) \quad (5)$$

Although, as was mentioned earlier, the response delay of the LAF sensor is caused by a chemical reaction and is therefore difficult to analyze, there was ascertained to be a correlation between the response delay and the engine speed. Therefore, the coefficient of the transfer function is varied relative to appropriately set graduations in the engine speed. As a result, the accuracy of the estimated air-fuel ratio value can be enhanced by using a different A/F estimator, i.e. a different inverse transfer function coefficient, for each prescribed graduation in engine speed.

Figure 3:
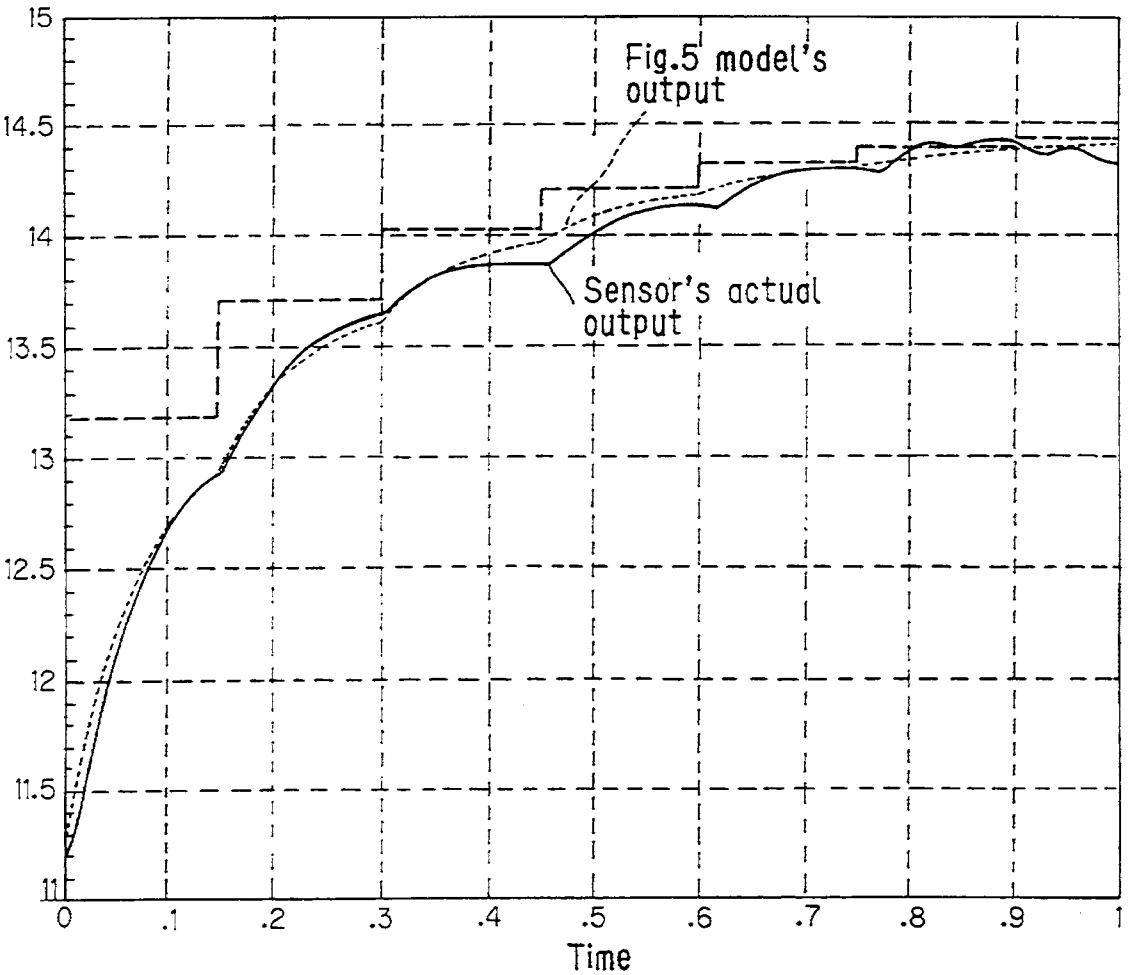
FIG. 3 is the result of simulation showing the detection response delay in the air-fuel ratio sensor (LAF sensor) when the amount of fuel to be supplied in one-cylinder engine was presumed to be varied stepwise while keeping the amount of air constant in contrast with an output of the LAF sensor in the condition.
Figure 4:
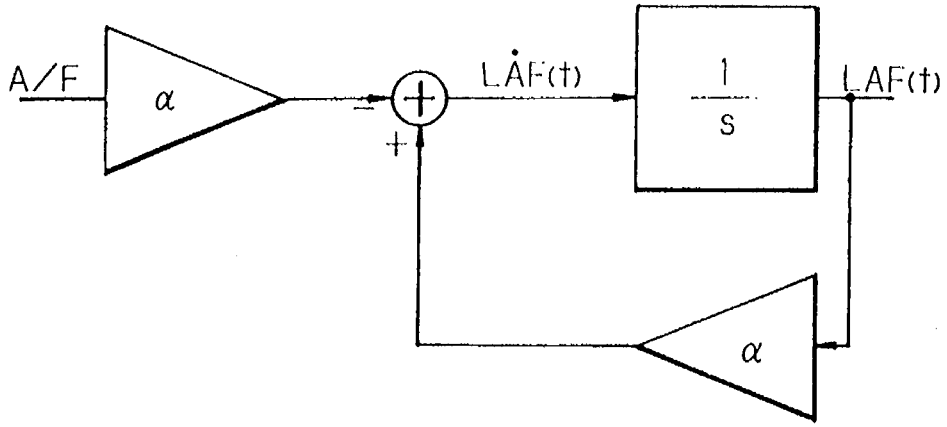
FIG. 4 is a block diagram showing a model describing the behavior of detection of the air-fuel ratio.
Figure 7:
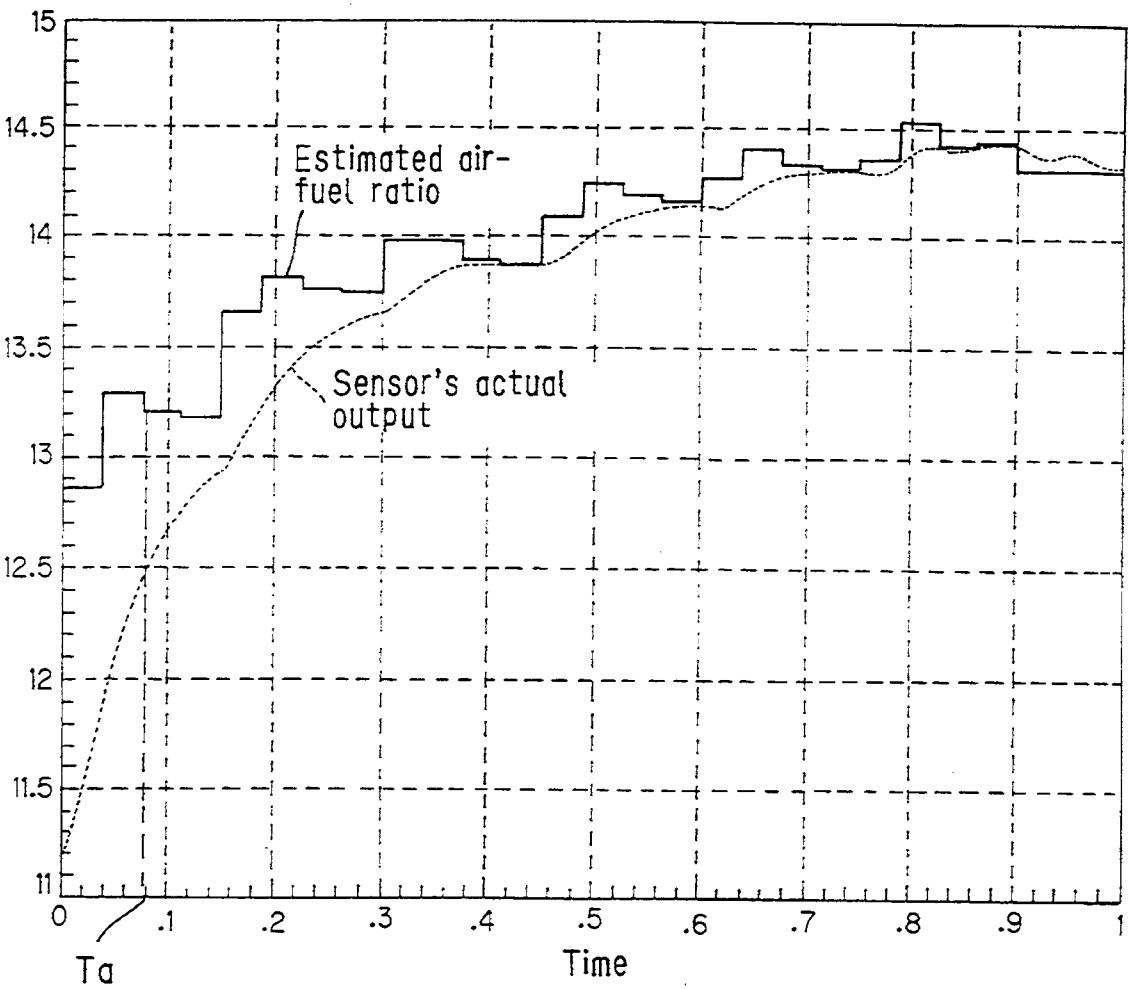
FIG. 7 is the result of simulation showing the air-fuel ratio estimated by the estimator of FIG. 6 in the same condition as that of FIG. 3 in contrast with an actual output of the LAF sensor.

The simulation results regarding the foregoing will be explained with reference to FIG. 3. As mentioned earlier, FIG. 3 shows the sensor's actual output obtained when graduated air-fuel ratios are input as illustrated by dashed lines. And, broken lines (dotted lines) indicate the output of the model (shown in FIG. 5) obtained when the stepwise air-fuel ratio is input. In this figure, the sensor's actual output and the model's output are seen to be substantially in agreement. The foregoing can be taken to verify the validity of the model simulating the sensor response delay as a first-order lag. FIG. 7 shows the result of the same simulation where the air-fuel ratio is estimated by multiplying the sensor actual output value by the inverse transfer function. From this figure, the air-fuel ratio at time Ta, for example, can be estimated to be 13.2:1, not 12.5:1. (The small ups and downs in the estimated air-fuel ratio are the result of fine variation in the detected sensor output.)

The separation and extraction of the air-fuel ratios of the individual cylinders using the air-fuel ratio estimated in the foregoing manner will now be explained.

As was explained earlier, when a single air-fuel ratio sensor is installed at or downstream of an exhaust gas confluence point of the exhaust system of a multiple cylinder internal combustion engine, the output of the sensor represents a mixture of the values at all of the cylinders. Since this makes it hard to obtain the actual air-fuel ratio at the individual cylinders, it was not up to now possible to control the air-fuel ratios at the individual cylinders precisely. As the air-fuel mixture therefore became lean at some cylinders and rich at others, the quality of the exhaust emissions was degraded. While this problem can be overcome by installing a separate sensor for each cylinder, this increases costs to an unacceptable level and also gives rise to problems regarding sensor durability. Now, by modeling the sensor detection response delay as a first-order lag, the inventors have made it possible to use the method explained in the following to ascertain with high accuracy the air-fuel ratios at the individual cylinders of a multiple cylinder (in the embodiment, a four-cylinder) internal combustion engine employing only a single air-fuel ratio sensor installed at or downstream of a confluence point of the exhaust system. The method will now be explained in detail.

Figure 8:
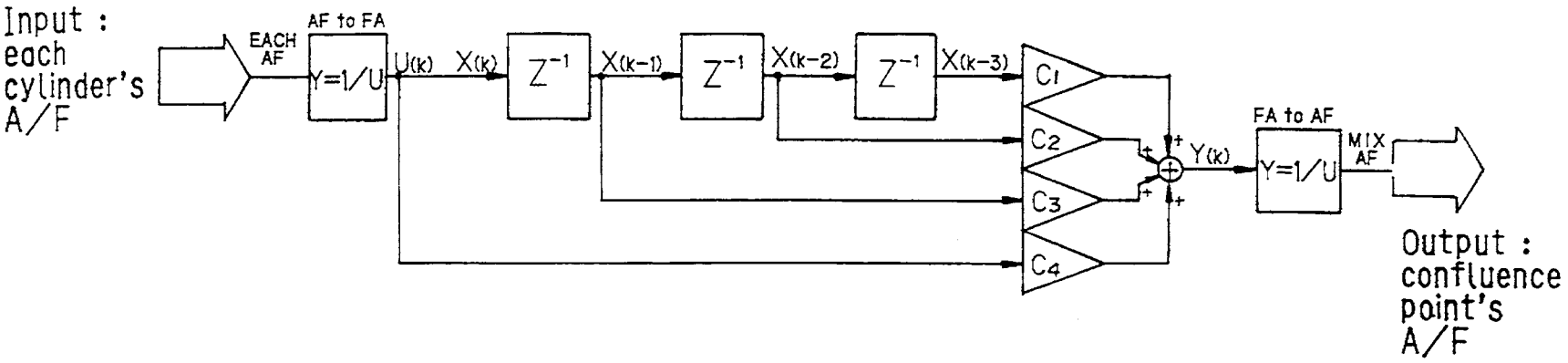
FIG. 8 is a block diagram showing a model named "exhaust gas model" describing the behavior of an exhaust system of the engine according to the invention.

The inventors first established the internal combustion engine exhaust system model shown in FIG. 8 (hereinafter called the "exhaust gas model"). The discretization sampling time in the exhaust gas model was made the same as the TDC (top dead center) period (0.02 sec at an engine speed of 1,500 rpm). And, as F (fuel) was selected as the controlled variable in the exhaust gas model, the term fuel-air ratio F/A was used instead of the air-fuel ratio A/F in the figure. However, for ease of understanding, the word "air-fuel ratio" will still be used in the following except that the use of the words might cause confusion.

The inventors then assumed the air-fuel ratio at the confluence point of the exhaust system to be an average weighted to reflect the time-based contribution of the air-fuel ratios of the individual cylinders. This made it possible to express the air-fuel ratio at the confluence point at time k in the manner of Equation (6).

$$\begin{aligned}
[F/A](k) &= C_1[F/A\#_1] + C_2[F/A\#_3] + C_3[F/A\#_4] + C_4[F/A\#_2] \\
[F/A](k+1) &= C_1[F/A\#_3] + C_2[F/A\#_4] + C_3[F/A\#_2] + C_4[F/A\#_1] \\
[F/A](k+2) &= C_1[F/A\#_4] + C_2[F/A\#_2] + C_3[F/A\#_1] + C_4[F/A\#_3] \\
&\ \ \vdots
\end{aligned} \tag{6}$$

More specifically, the air-fuel ratio at the confluence point can be expressed as the sum of the products of the past firing histories of the respective cylinders and weights C (for example, 40% for the cylinder that fired most recently, 30% for the one before that, and so on). It must be noted, however, that the state in which the exhaust gases from the individual cylinders mix at the confluence point varies with the engine operating condition. For example, since the TDC period is long in the low-speed region of the engine, the degree of mixing of the exhaust gases from the different cylinders is lower than in the high-speed region. On the other hand, during high-load operation, since the back pressure and the exhaust gas discharge pressure are fundamentally larger, the degree of mixing of the exhaust gases from the different cylinders is lower than during low-load operation. When the degree of mixing of the exhaust gases from the different cylinders is low, it becomes necessary to increase the weight of the cylinder that fired most recently. In the invention therefore the weight C is varied according to the engine operation condition. This is achieved by appropriately preparing look-up tables for the weights C relative to the engine speed and the engine load as parameters and retrieving the weight C for the current operating condition from the tables. Incidentally, the #n in the equation indicates the cylinder number, and the firing order of the cylinders is defined as 1, 3, 4, 2. The air-fuel ratio here, correctly the fuel-air ratio (F/A), is the estimated value obtained by correcting for the response delay.

Based on the aforesaid assumptions, the state equation of the exhaust gas model can be written as $$\begin{bmatrix} x(k-2) \\ x(k-1) \\ x(k) \end{bmatrix} = \begin{bmatrix} 010 \\ 001 \\ 000 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \tag{7}$$

Further, if the air-fuel ratio at the confluence point is defined as y(k), the output equation can be written as $$y(k) = [C_1\ C_2\ C_3] \begin{bmatrix} x(k-3) \\ x(k-2) \\ x(k-1) \end{bmatrix} + C_4 u(k) \tag{8}$$

Here:
$C_1$:0.25379, $C_2$:0.46111, $C_3$:0.10121, $C_4$:0.18389

Since u(k) in this equation cannot be observed, it will still not be possible, even if an observer is designed from the equation to observe x(k). However, if one defines x(k+1)= x(k−3) on the assumption of a stable operating state in which there is no abrupt change in the air-fuel ratio from that 4 TDC earlier (i.e., from that of the same cylinder), Equation (9) will be obtained.

$$\begin{bmatrix} x(k-2) \\ x(k-1) \\ x(k) \\ x(k+1) \end{bmatrix} = \begin{bmatrix} 0100 \\ 0010 \\ 0001 \\ 1000 \end{bmatrix} \begin{bmatrix} x(k-3) \\ x(k-2) \\ x(k-1) \\ x(k) \end{bmatrix} \tag{9}$$

$$y(k) = [C_1\ C_2\ C_3\ C_4] \begin{bmatrix} x(k-3) \\ x(k-2) \\ x(k-1) \\ x(k) \end{bmatrix}$$

Figure 9:
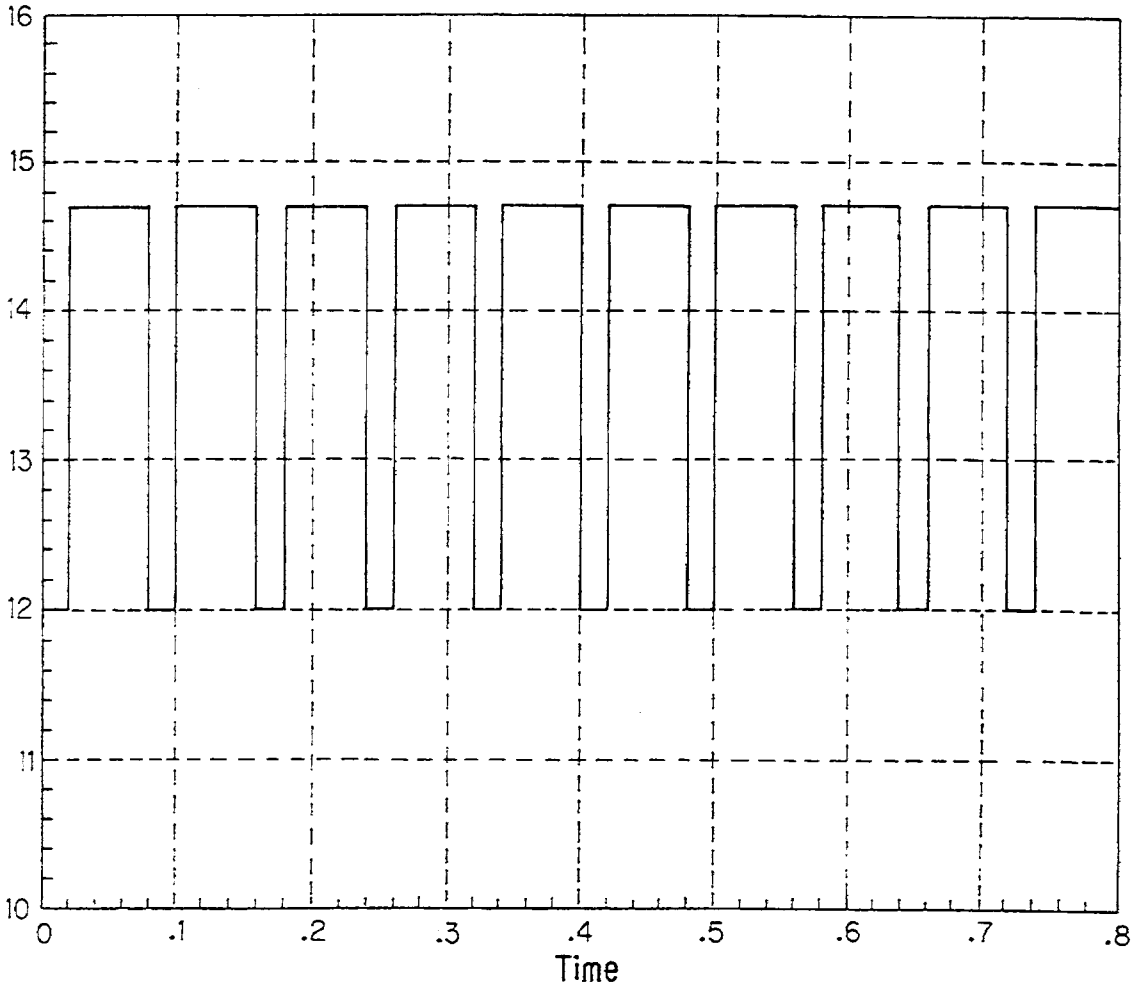
FIG. 9 is an explanatory view of simulation such that fuel is assumed to be supplied to three cylinders of a four-cylinder engine so as to obtain an air-fuel ratio of 14.7:1 and to one cylinder so as to obtain an air-fuel ratio of 12.0:1.
Figure 10:
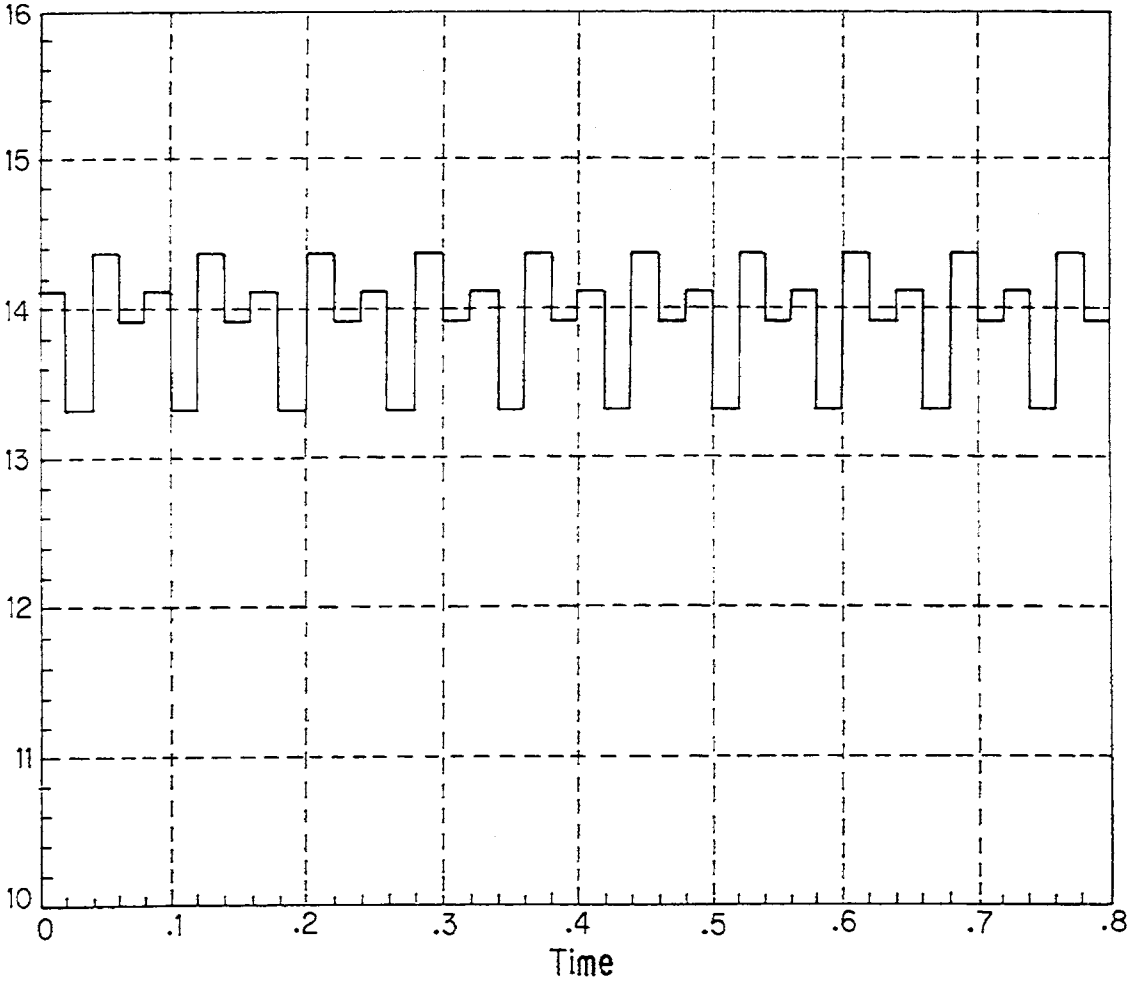
FIG. 10 is the result of the simulation showing the output of the exhaust gas model indicative of the air-fuel ratio at a confluence point when the fuel is supplied in the manner illustrated in FIG. 9.
Figure 11:
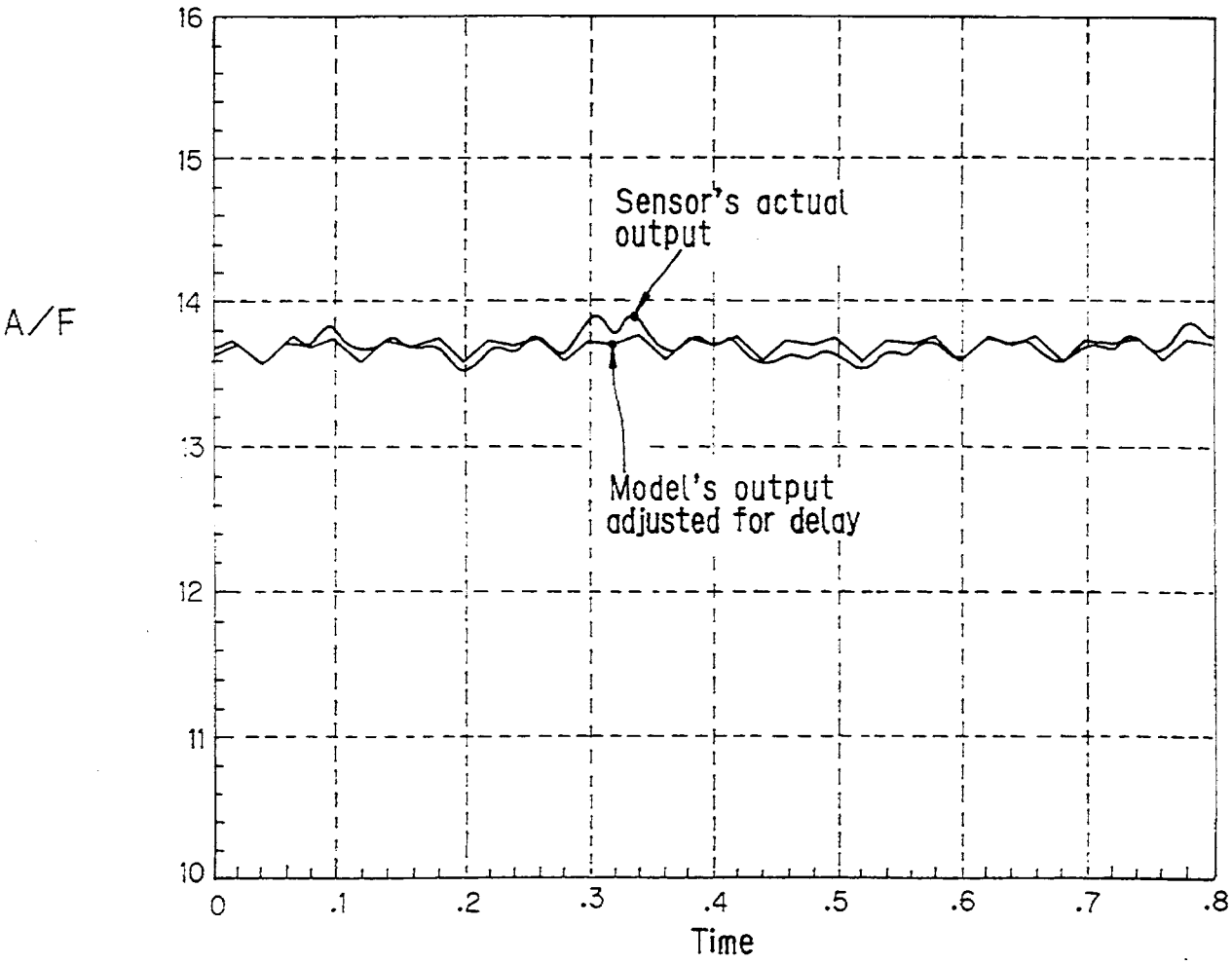
FIG. 11 is the result of the simulation showing the output of the exhaust gas model adjusted for sensor detection response delay in contrast with the sensor's actual output.

The simulation results for the exhaust gas model obtained in the foregoing manner will now be given. FIG. 9 shows a situation of the simulation in which fuel is supplied to three cylinders of a four-cylinder internal combustion engine so as to obtain an air-fuel ratio of 14.7:1 and to one cylinder so as to obtain an air-fuel ratio of 12.0:1. FIG. 10 shows the air-fuel ratio at this time at the confluence point (the position where the air-fuel ratio sensor 40 is located in the exhaust pipe 24 in FIG. 1) as obtained using the aforesaid exhaust gas model. While FIG. 10 shows that a stepped output is obtained, when the response delay of the LAF sensor is taken into consideration, the sensor output becomes the smoothed wave designated "Model's output adjusted for delay" in FIG. 11. The close agreement of the waveforms of the model's output and the sensor's output verifies the validity of the exhaust gas model as a model of the exhaust gas system of a multiple cylinder internal combustion engine.

Thus, the problem comes down to one of an ordinary Kalman filter in which x(k) is observed in the state equation and the output equation shown in Equation (10). When the weighted matrices Q, R are determined as shown in Equation (11) and the Riccati's equation is solved, the gain matrix K becomes as shown in Equation (12).

$$\begin{cases} X(k+1) & :: & AX(k)+Bu(k) \\ y(k) & :: & CX(k)+Du(k) \end{cases} \tag{10}$$

Here:

$$A :: \begin{bmatrix} 0100 \\ 0010 \\ 0001 \\ 1000 \end{bmatrix} \quad C :: [C_1C_2C_3C_4] \quad B :: D :: [0]$$

$$X(k) :: \begin{bmatrix} x(k-3) \\ x(k-2) \\ x(k-1) \\ x(k) \end{bmatrix}$$

$$Q :: \begin{bmatrix} 1000 \\ 0100 \\ 0010 \\ 0001 \end{bmatrix} \quad R :: [1] \tag{11}$$

$$K :: \begin{bmatrix} -0.3093 \\ 1.1918 \\ 0.3093 \\ 0.0803 \end{bmatrix} \tag{12}$$

Obtaining A-KC from this gives Equation (13).

$$A-KC :: \begin{bmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & -0.0148 \end{bmatrix} \tag{13}$$

Figure 12:
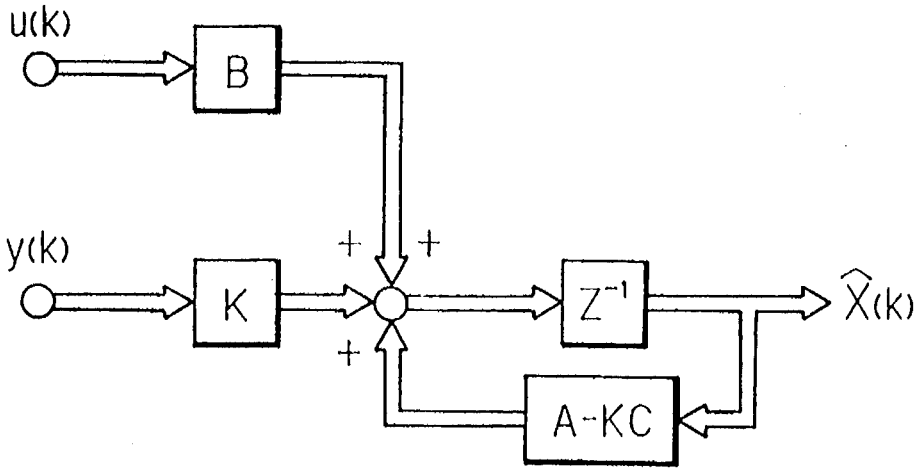
FIG. 12 is a block diagram showing the configuration of an ordinary observer.
Figure 13:
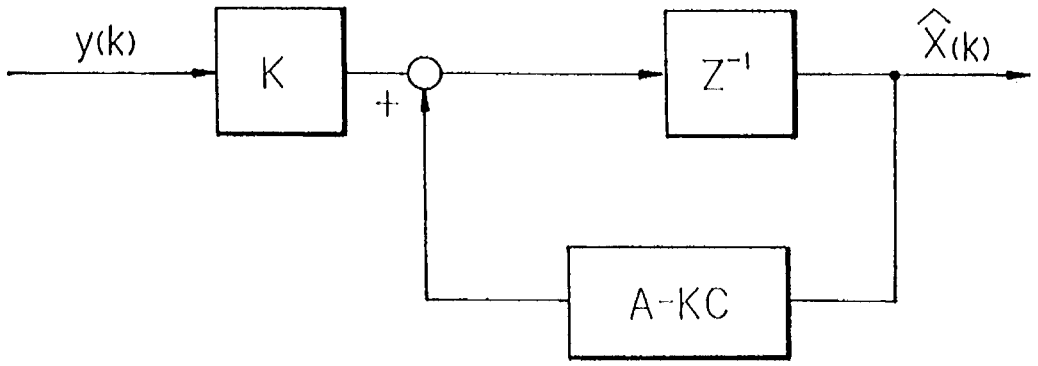
FIG. 13 is a block diagram showing the configuration of the observer according to the present invention.

FIG. 12 shows the configuration of an ordinary observer. Since there is no input u(k) in the present model, however, the configuration has only y(k) as an input, as shown in FIG. 13. This is expressed mathematically by Equation (14).

$$\begin{cases} \hat{X}(k+1) & :: & [A-KC]\hat{X}(k)+y(k) \\ \hat{x}(k) & :: & [0001]\hat{X}(k) \end{cases} \tag{14}$$

The system matrix S of the observer whose input is y(k), namely of the Kalman filter, is $$S :: \begin{bmatrix} A-KC & K \\ 0001 & 0 \end{bmatrix} \tag{15}$$

In the present model, when the ratio of the member of the weight imputation R in Riccati's equation to the member of Q is 1:1, the system matrix S of the Kalman filter is given as $$S :: \begin{bmatrix} 0.0785 & 1.0313 & 0.1426 & 0.0569 & -0.3093 \\ -0.3025 & -0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 1.0 & 0.0 \end{bmatrix} \tag{16}$$

The waveforms of the simulated air-fuel ratios at the respective cylinders are then precisely drawn and the result is input to the exhaust gas model to obtain the air-fuel ratio at the confluence point, which is in turn input to the observer for verifying the estimation of the air-fuel ratios at the individual cylinders. The tendency of the weighted matrix and the estimated values is also examined.

Since Equation (17) applies in the present model, the weighted matrix Q is a diagonal matrix whose members are all the same.

$$X(k)\ [x(k-3)\ x(k-2)\ x(k-1)\ x(k)]' \tag{17}$$

Figure 15:
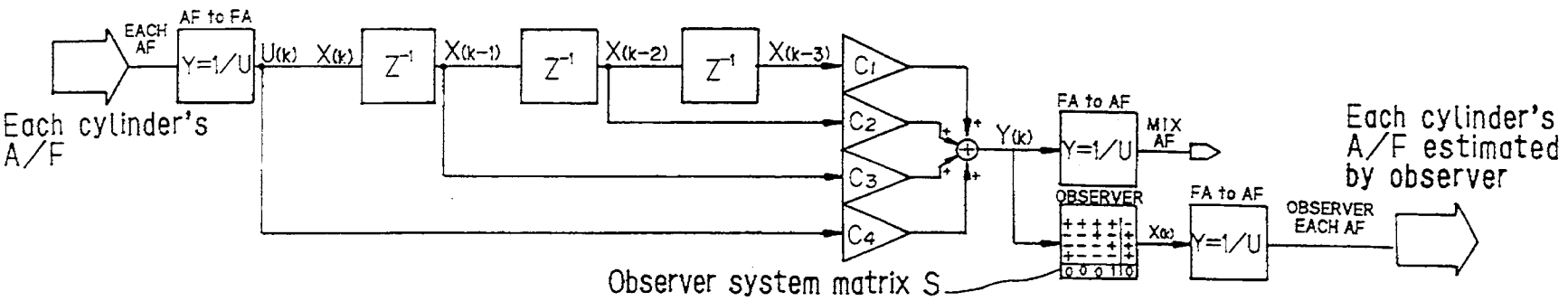
FIG. 15 is an explanatory block diagram showing a simulation model made up of the model of FIG. 8 and the observer of FIG. 13.
Figures 16, 16B:
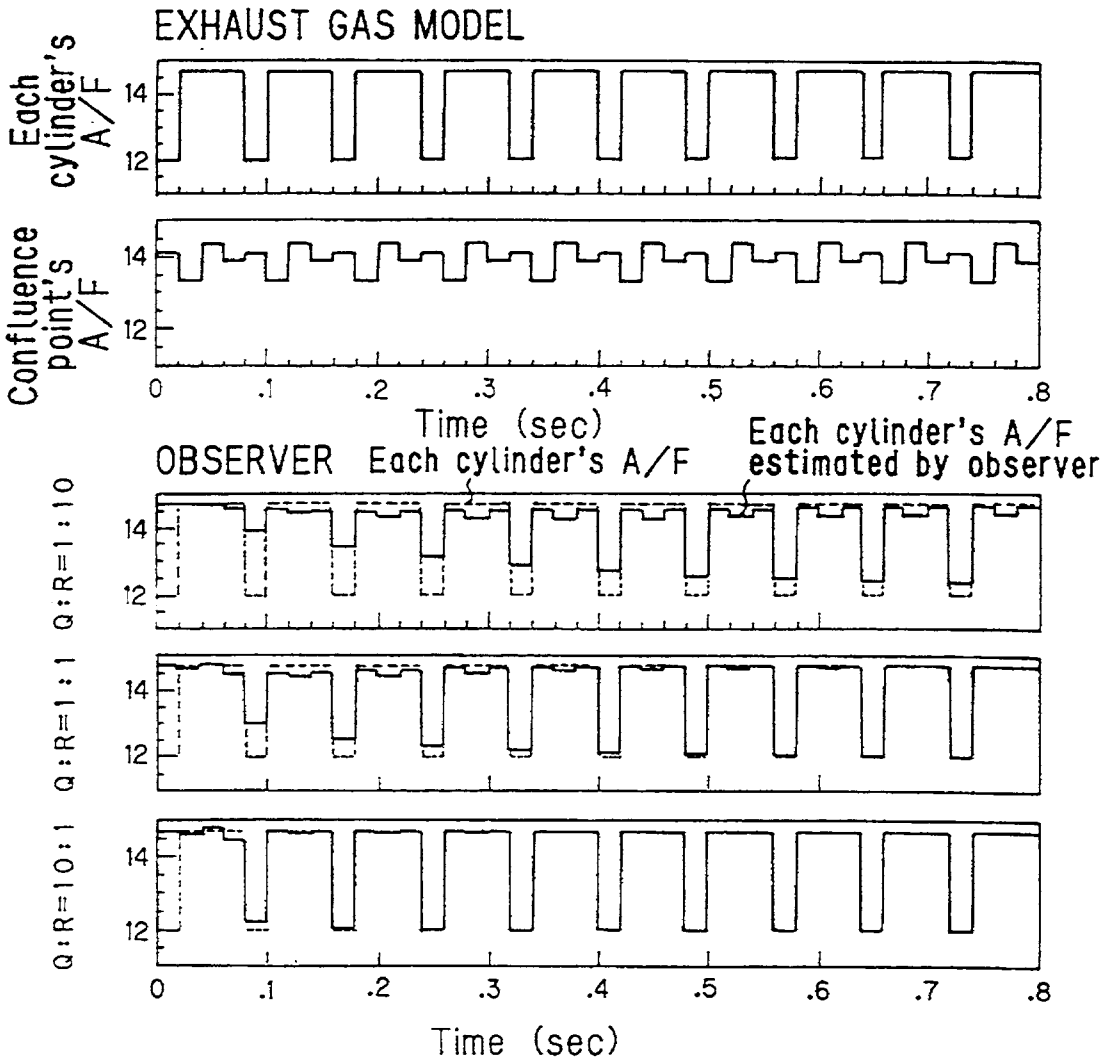
FIG. 16 is the result of simulation in which the air-fuel ratio is obtained for the respective cylinders when values of 12.0:1, 14.7:1, 14.7:1, 14.7:1 are input.
Figure 18:
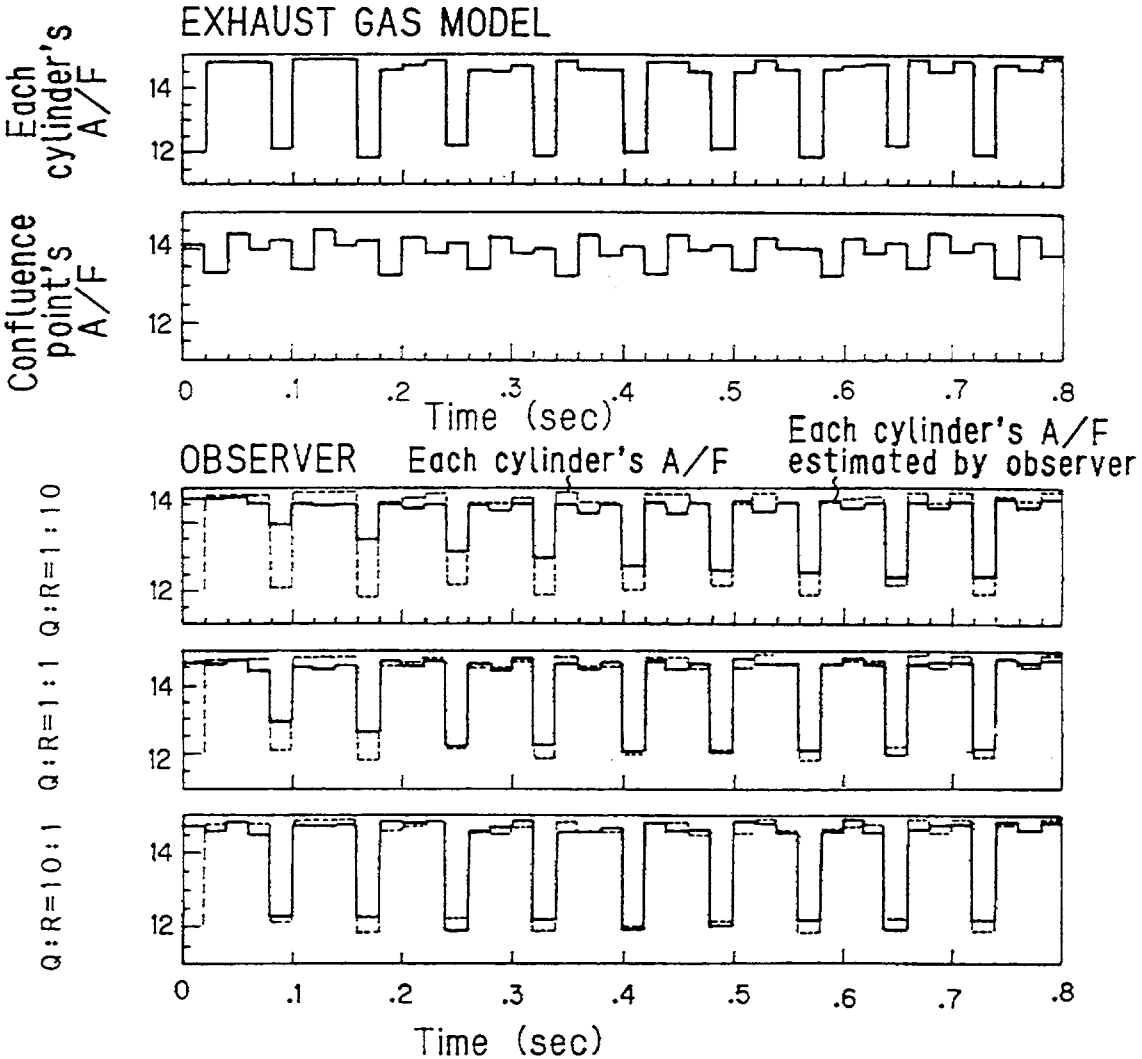
FIG. 18 is the result of another simulation in which imaginary noise is added to the input of FIG. 16.

What needs to be examined, therefore, are the ratio of the members of Q and R. The gains obtained by varying the ratio between the members of Q and R are shown in a table of FIG. 14. The simulation model combining the observer constituted using these gains with the exhaust gas model is shown in FIG. 15. In addition, the results of the computation using this model when values 12.0:1, 14.7:1, 14.7:1, 14.7:1 are input as the air-fuel ratios at the individual cylinders are as shown in FIG. 16 and the observer's estimation error at this time between the target ratio and the estimated ratio is as shown in a table of FIG. 17. The results of the computation using this model when the air-fuel ratios were independently varied within the ranges of 12.0±0.2:1, 14.7±0.2:1, 14.7±0.2:1, 14.7±0.2:1 (for noise simulation) are shown in FIG. 18 and the observer's estimation error at this time is as shown in a table of FIG. 19. In each of FIGS. 16 and 18, (*a*) to (*e*) have the following meanings:

(a) Air-fuel ratio of the respective cylinders (exhaust gas model input), (b) Air-fuel ratio at confluence point (exhaust gas model output), (c) Observer output (input indicated by (b)) when Q member : R member= 1:10, (d) Observer output (input indicated by (b)) when Q member : R member= 1:1, and (e) Observer output (input indicated by (b)) when Q member : R member= 10:1.

Figure 20:
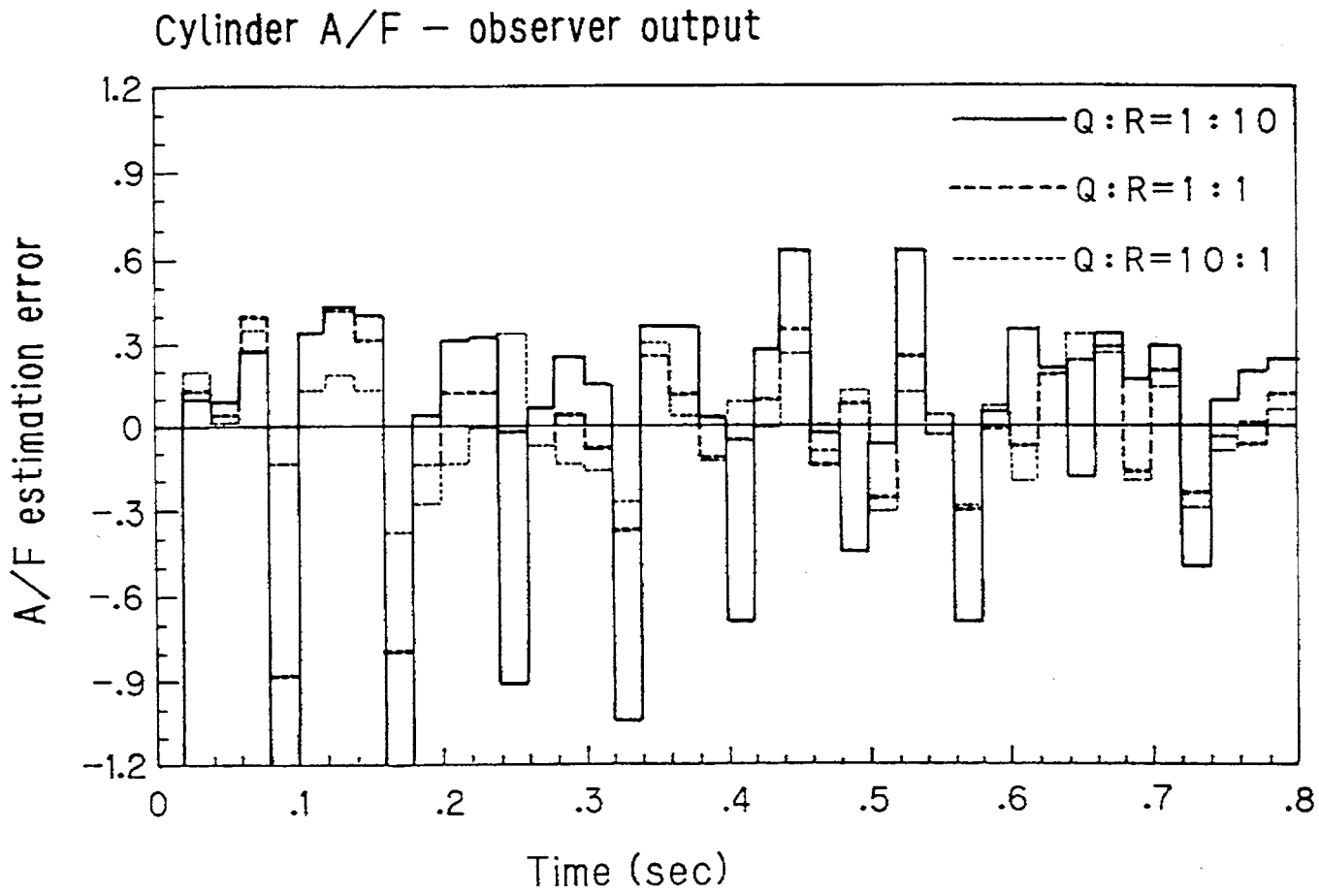
FIG. 20 is a view illustrating the error of FIG. 18 in time series.

It will be noted from FIG. 16 that when the same air-fuel ratio was set for all cylinders, the rate of convergence increased with increasing weight of Q. However, increasing Q/R to 10 or greater caused substantially no change in the convergence. The error (target air-fuel ratio at each cylinder− estimated air-fuel ratio at each cylinder) in FIG. 18 in time series will be shown in FIG. 20. After converged in the observer there is little difference between the case where the ratio of Q member: R member is 10:1 and the case where it is 1:1 and, therefore, taking external disturbance into account, Q member: R member= 1:1 is preferable. Thus the observer using the Kalman theory with respect to the input air-fuel ratio at the confluence point is able to estimate the individual cylinder air-fuel ratios with high precision at the confluence point. (Although the weighted matrix was best at Q/R=1−10, it is considered necessary to determine it from the response using actual data.)

Figures 21, 21E:
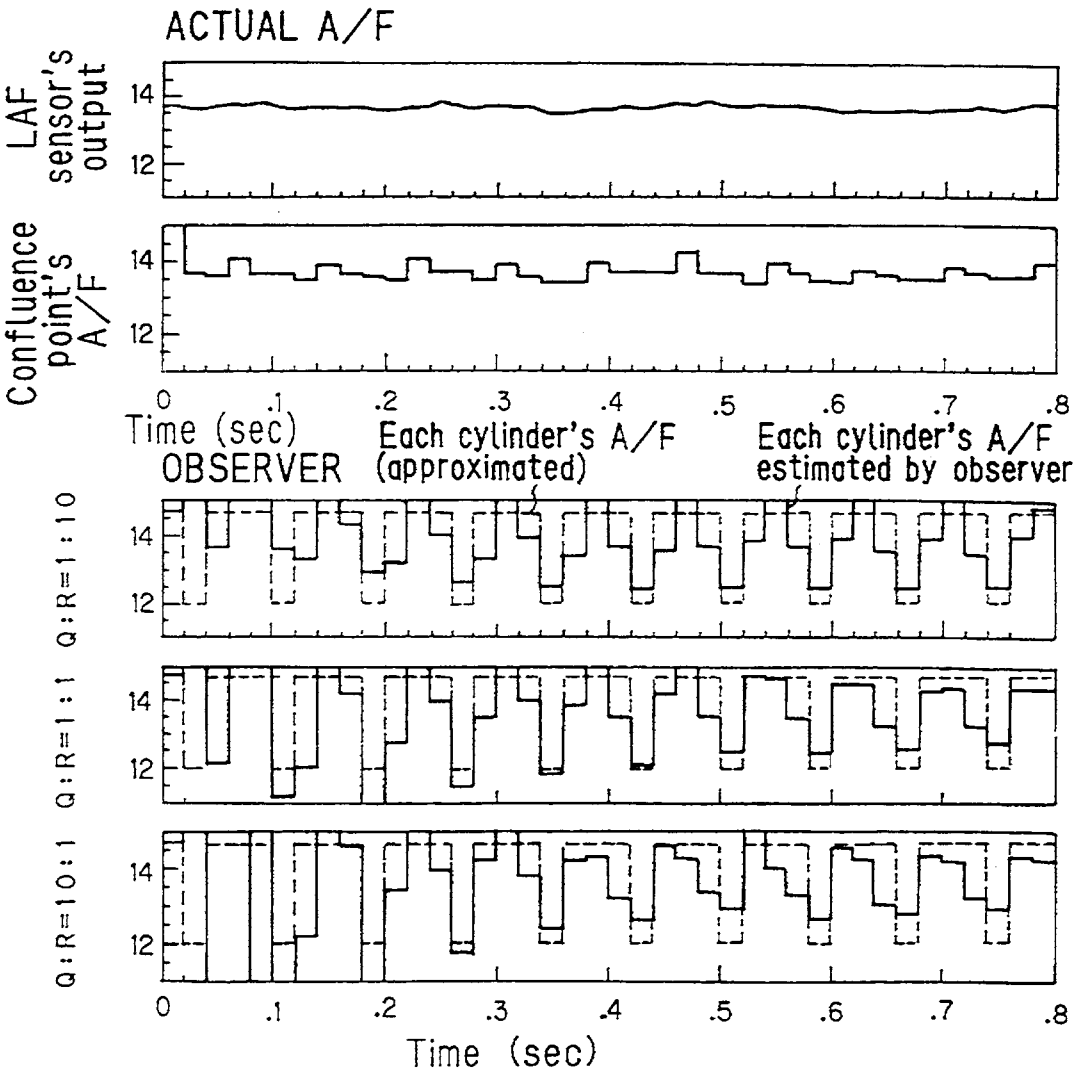
FIG. 21 is the result of simulation illustrating the estimated air-fuel ratios at the individual cylinders obtained by inputting to the observer the actual confluence point air-fuel ratio data obtained by the air-fuel ratio estimator.

FIG. 21 shows the result of simulation in which the estimated air-fuel ratios at the individual cylinders obtained by inputting to the observer the actual confluence point air-fuel ratio data obtained by multiplying the actually measured data by the aforesaid inverse transfer function of the A/F estimator. In this figure:

(a) LAF sensor output, (b) Air-fuel ratio at confluence point (real-time A/F estimator's output (input to the observer), (c) Observer output when Q member:R member= 1:10 (input indicated by (b)), (d) Observer output when Q member: R member=1:1 (input indicated by (b)), and (e) Observer output when Q member:R member= 10:1 (input indicated by (b)).

The LAF sensor output measurement conditions were: engine speed=1,500 rpm, air intake manifold pressure =−281.9 mmHg, A/F=12.0:1 (#2), 14.7:1 (#1, #3, #4).

Since the true values of the actual input air-fuel ratios were unknown, 12.0:1, 14.7:1, 14.7:1, 14.7:1 were used as approximate values in the simulation. As can be seen from this figure, the observer output varies in cycles of 4 TDC and substantially estimates the input air-fuel ratio. Moreover, the figure shows that the use of the Kalman filter enables convergence in 2 to 8 cycles, depending on how the weighted matrices are set.

Use of the cylinder air-fuel ratios estimated in the foregoing manner for controlling the air-fuel ratios to the target value will now be explained.

Figure 22:
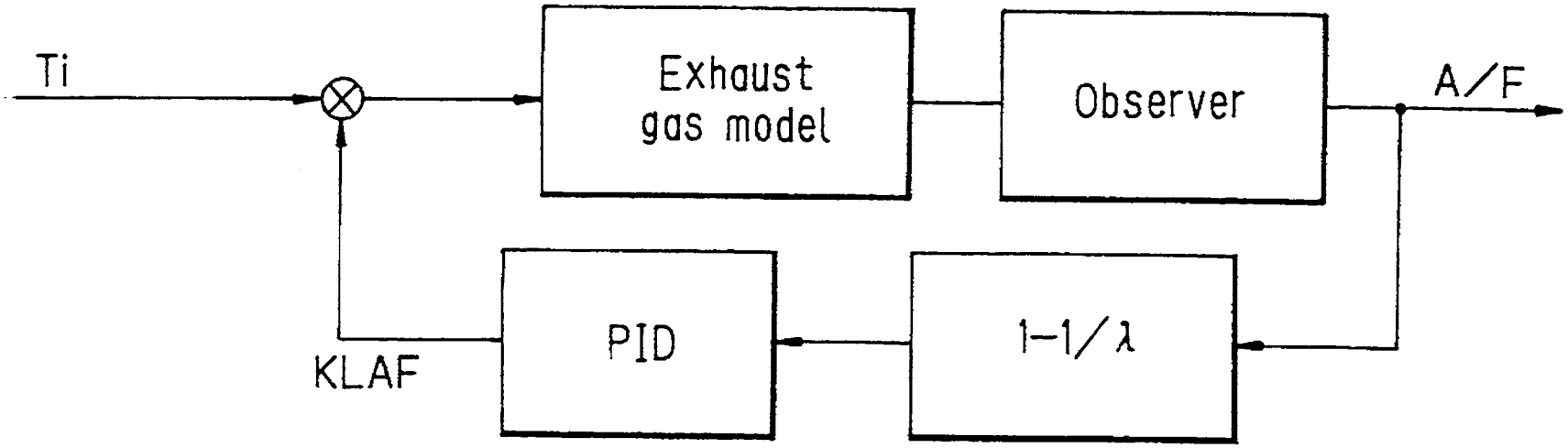
FIG. 22 is a block diagram showing a control in which the air-fuel ratio is controlled to a target ratio through the PID technique.

An example of this control using the PID technique is shown in the block diagram of FIG. 22. Although the illustrated control differs from ordinary PID control in the point that it conducts feedback through a multiplication term, the control method itself is well known. As shown, it suffices to calculate for each cylinder the deviation (1−1/lambda) of the actual air-fuel ratio from the target value that results from input Ti (injection period) and to feedback the product of this and a corresponding gain KLAF so as to obtain the target value. While the method is well known, its ability to provide control for adjusting the air-fuel ratios of the individual cylinders to the target value is dependent on the highly accurate detection of the air-ratios of the individual cylinders made possible by the invention as described in the foregoing.

Figure 23:
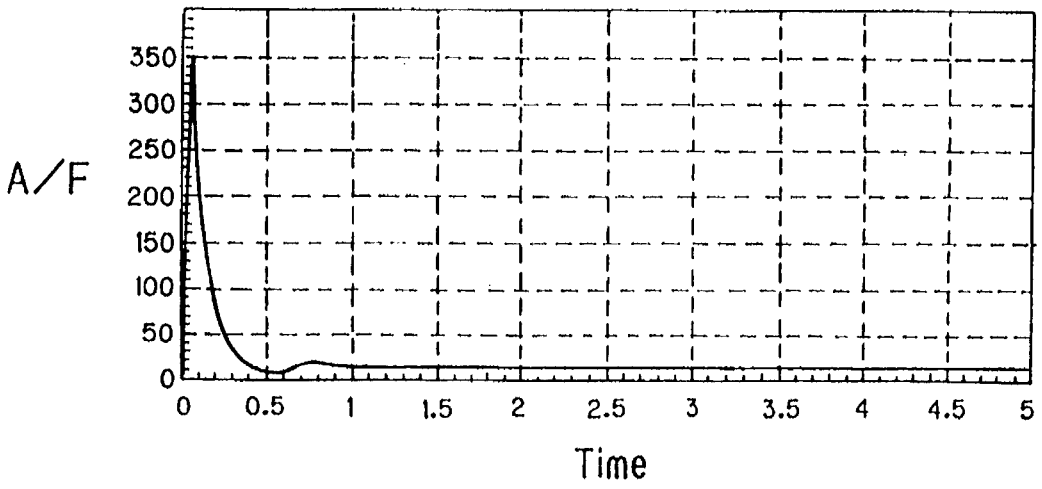
FIG. 23 to 27 are the results of simulation indicating the PID control of FIG. 22.
Figure 24:
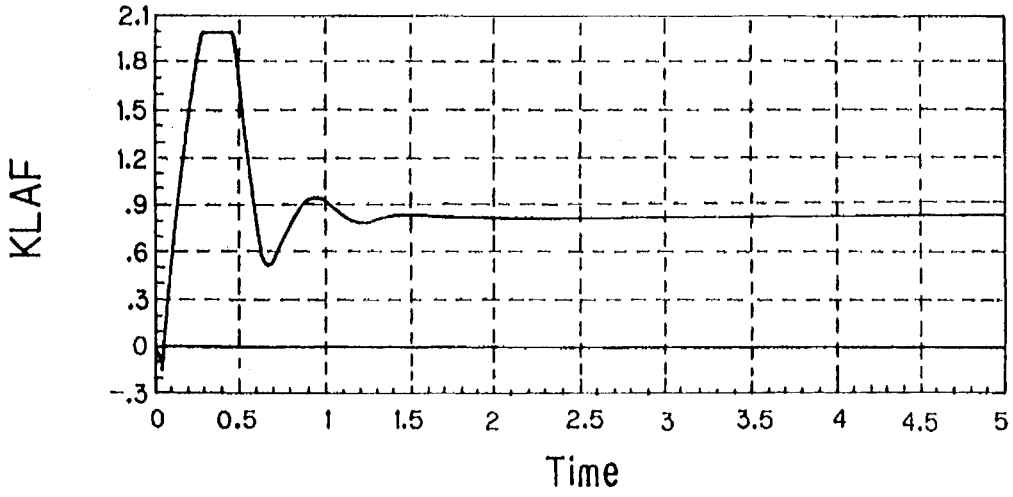
Figure 25:
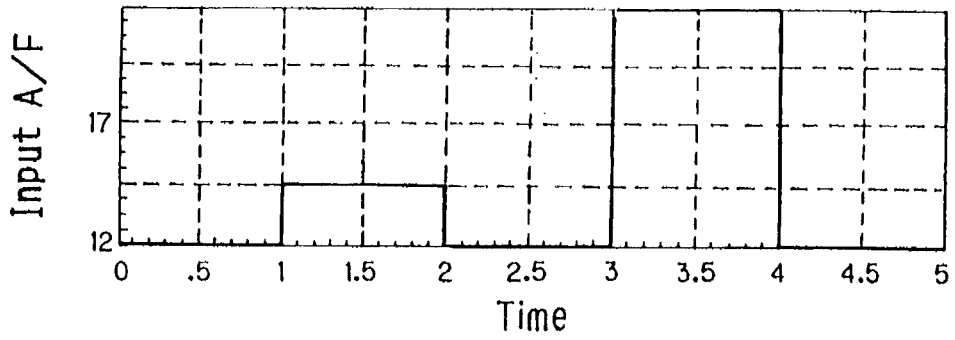
Figure 26:
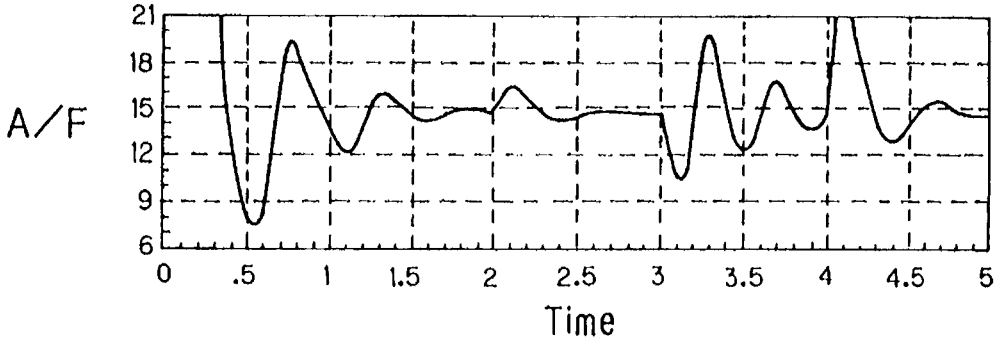
Figure 27:
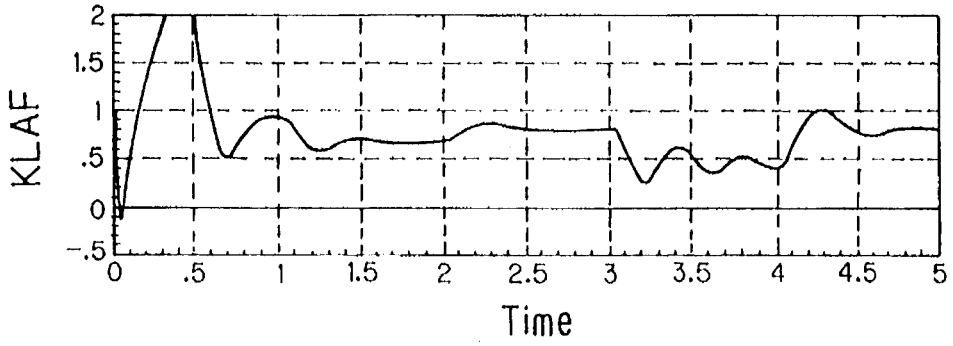

Since the need to prevent hunting in the aforesaid PID control makes it impossible to set the feedback gain too high, however, the control convergence is not as good as might be desired. FIGS. 23–27 show simulation results indicating the response of the PID control of FIG. 22. FIG. 23 shows the air-fuel ratio output characteristics when the input air-fuel ratio was fixed (21.0:1), FIG. 24 the characteristics of the corresponding feedback gain KLAF, FIG. 25 other input air/fuel ratio characteristics, FIG. 26 the air-fuel ratio output characteristics at this time, and FIG. 27 the characteristics of the corresponding gain KLAF. As is clear from FIG. 26, the convergence is by no means rapid.

Therefore, an explanation will now be made with regard to the deadbeat control which enables immediate convergence on the target value with deadbeat response.

Figure 28:
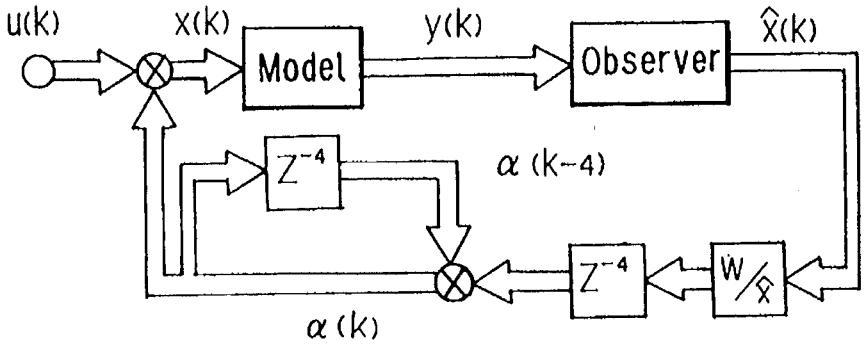
FIG. 28 is a block diagram showing the configuration of the deadbeat control according to the present invention.

Consideration will be given to feedback wherein, as a fundamental policy, convergence on the target air-fuel ratio W is achieved by correcting the input u(k) using the ratio W/x circumflex (k) between the observer-estimated air-fuel ratio x circumflex (k) and the target air-fuel ratio W. In the model of FIG. 15, when feedback control of the individual cylinders is conducted using as the gain α(k) the result of accumulating the ratios of the observer-estimated air-fuel ratio x circumflex (k) and the target air-fuel ratio W, we get what is shown in FIG. 28. Assuming the input at this time to be u(k), it holds that $$x(k)=\alpha(k)\cdot u(k) \tag{18}$$

$$\alpha(k)=\alpha(k-4)\cdot W/\hat{x}(k-4) \tag{19}$$

From Equation 18, it follows that $$\begin{aligned} x(k-4) &= \alpha(k-4)\cdot u(k-4) \\ \frac{x(k)}{x(k-4)} &= \frac{\alpha(k)}{\alpha(k-4)}\cdot\frac{u(k)}{u(k-4)} \end{aligned} \tag{20}$$

and from Equation (19), that $$\begin{aligned} \alpha(k)/\alpha(k-4) &= W/\hat{x}(k-4) \\ \frac{x(k)}{x(k-4)} &= \frac{W}{\hat{x}(k-4)}\cdot\frac{u(k)}{u(k-4)} \end{aligned} \tag{21}$$

Therefore, when u(k)/u(k−4)~1, K→∞, if x(k−4)→x(k−4), then when k→∞, it should follow that x(k)→W.

Expressed in general terms, this becomes Current output] =[Current input] ×[Target value] /[Current estimated output value] ×

[Preceding correction value for specific control cycle]

In this case, "Preceding correction value for specific control cycle" means the output four control cycles (TDC) earlier, i.e. for the output for the same cylinder (in a four-cylinder engine). However, when this gain was actually used in feedback simulation, the control did not stabilize.

Figure 29:
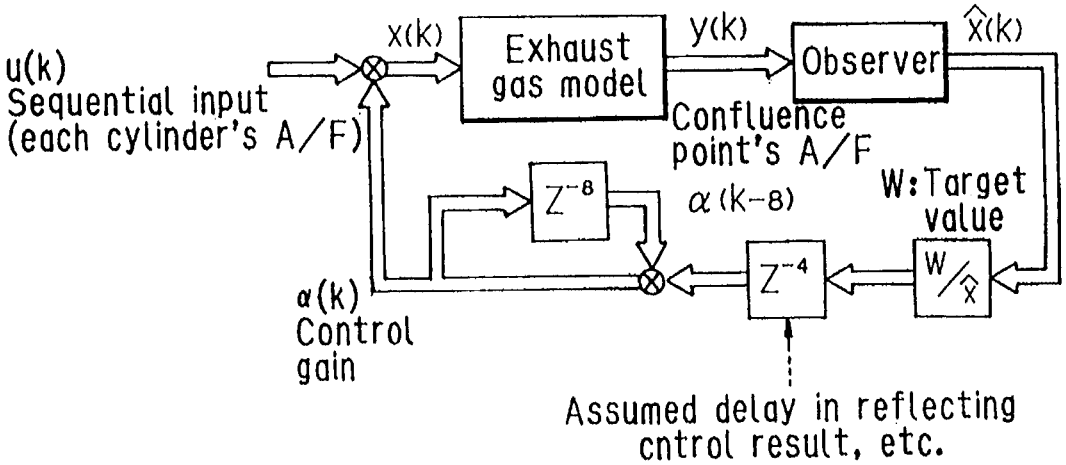
FIG. 29 is a block diagram, similar to FIG. 28, but showing modified configuration of the control of FIG. 28.

If the value two times earlier is used for introducing a delay into the cumulative calculation of the gain α(k), the result is as shown in FIG. 29. At this time it holds that $$\alpha(k)=\alpha(k-8)\cdot W/\hat{x}(k-4) \tag{22}$$

Making the same calculation without a delay gives $$\begin{aligned} \frac{x(k)}{x(k-8)} &= \frac{\alpha(k)}{\alpha(k-8)}\cdot\frac{u(k)}{u(k-8)} \\ &= \frac{W}{\hat{x}(k-4)}\cdot\frac{u(k)}{u(k-8)} \end{aligned} \tag{23}$$

and the control stabilized.

Figure 30:
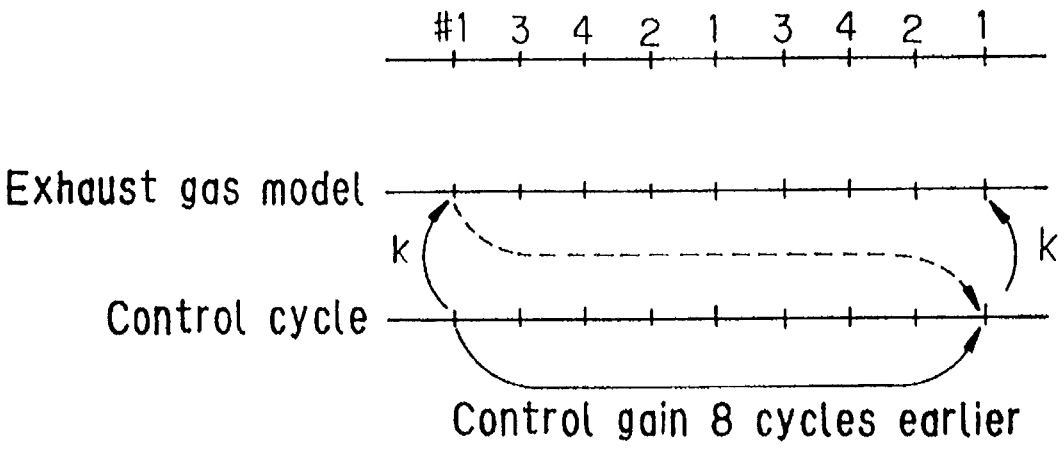
FIG. 30 is a view explaining how to determine the gain of the control of FIG. 29 and the reason why the control stabilizes.
Figure 31:
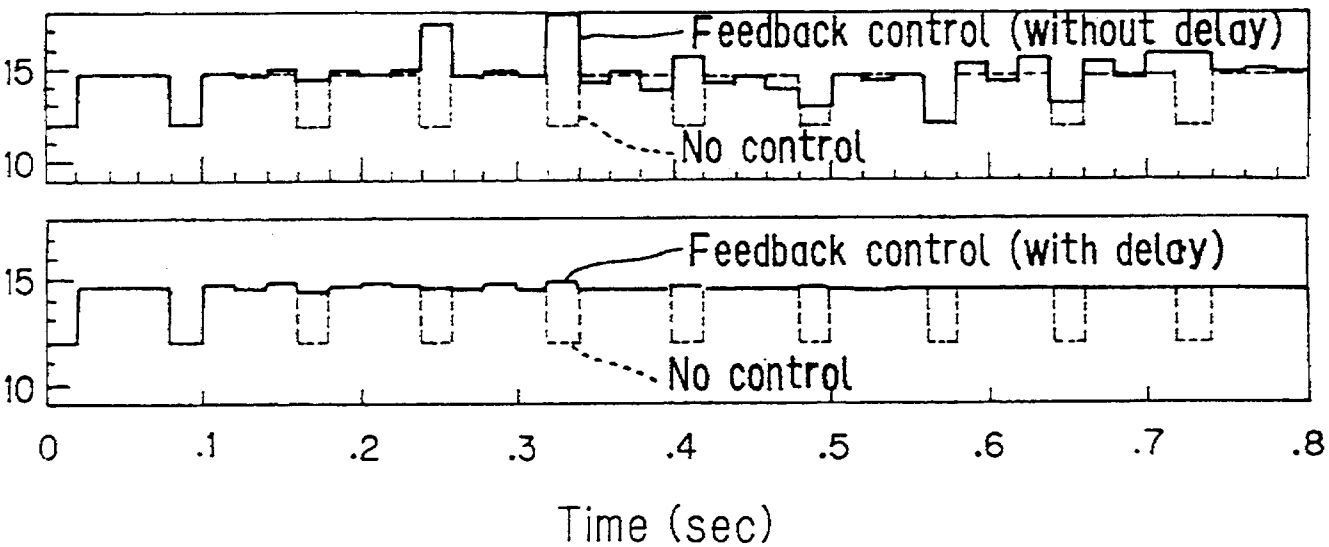
FIG. 31 is the result of simulation of the control of FIG. 30.
Figure 32:
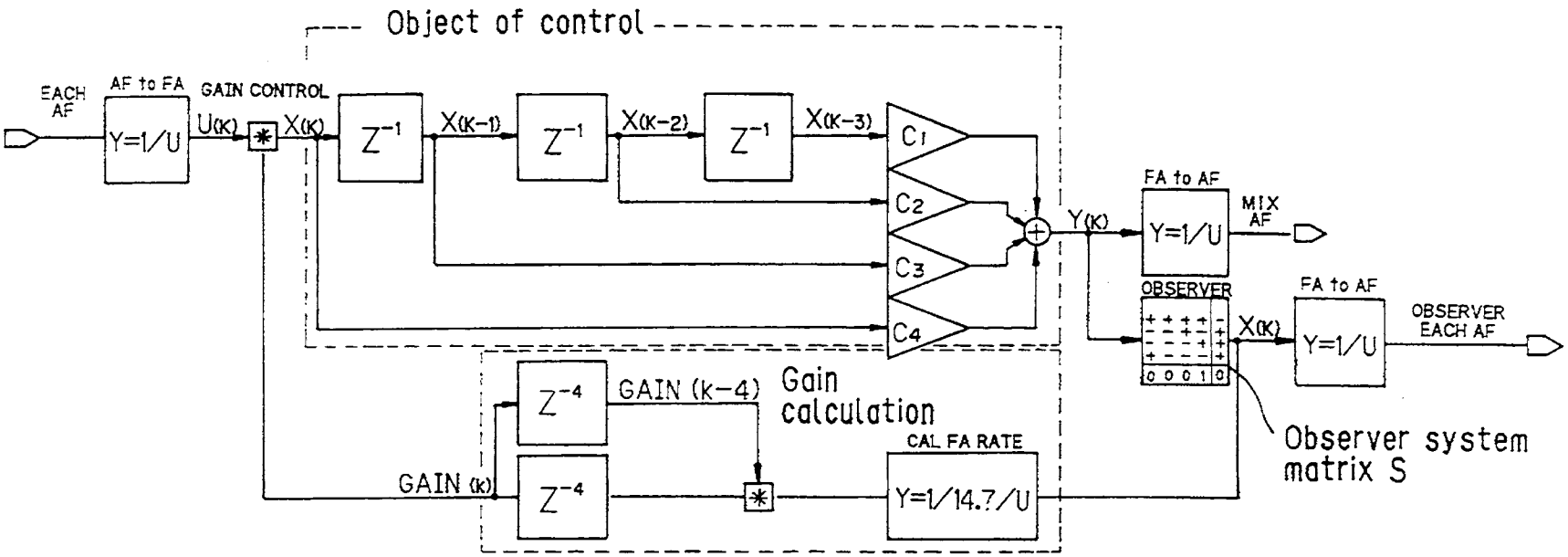
FIG. 32 is a block diagram showing the model used in the deadbeat control according to the present invention.
Figure 33:
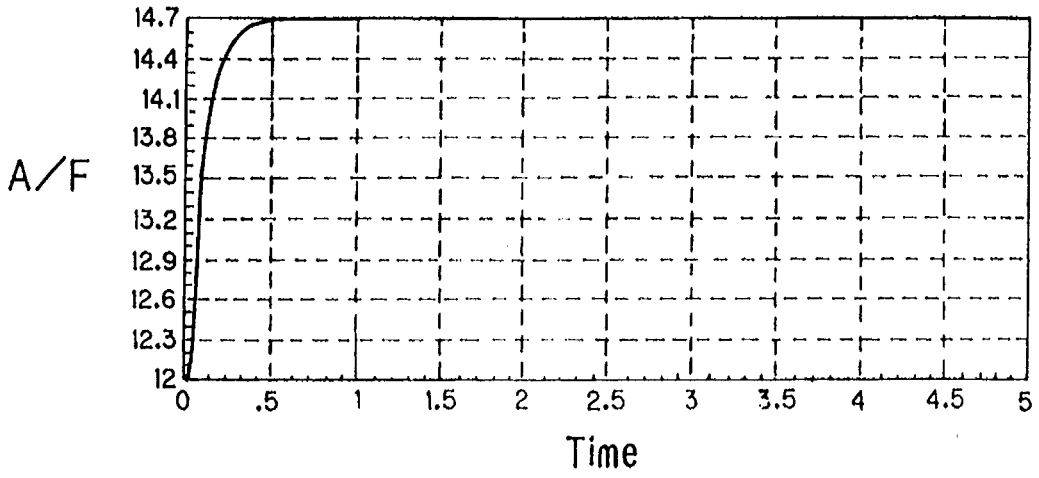
FIGS. 33 to 37 are results of simulation using the model of FIG. 32.
Figure 34:
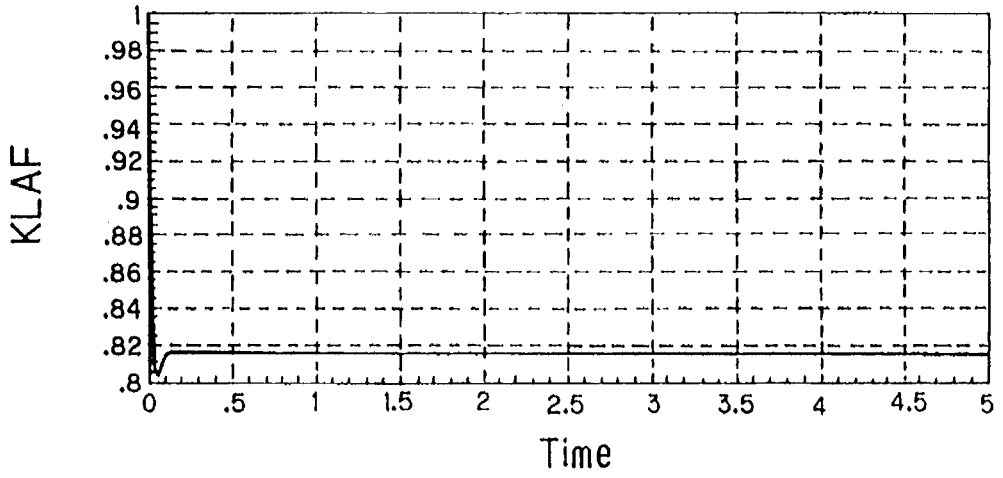
Figure 35:
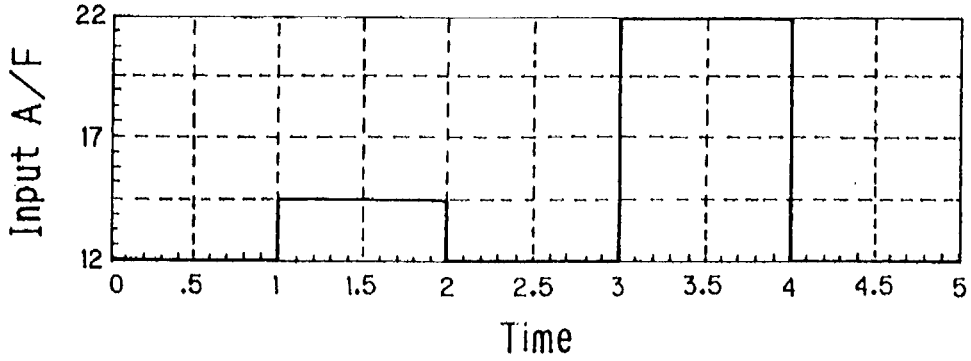
Figure 36:
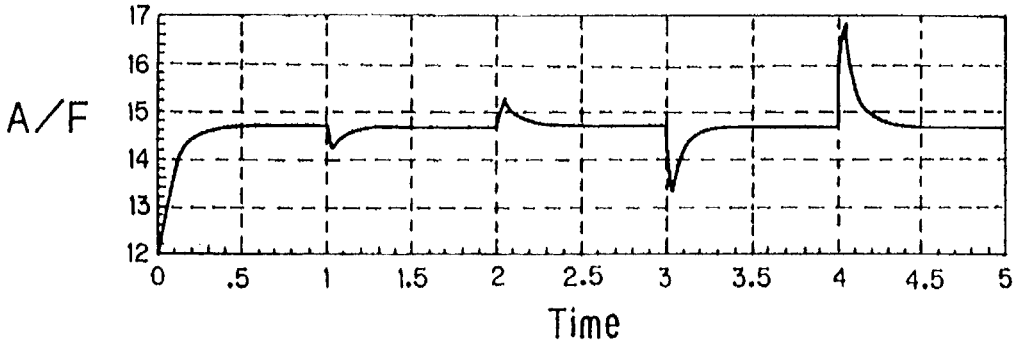
Figure 37:
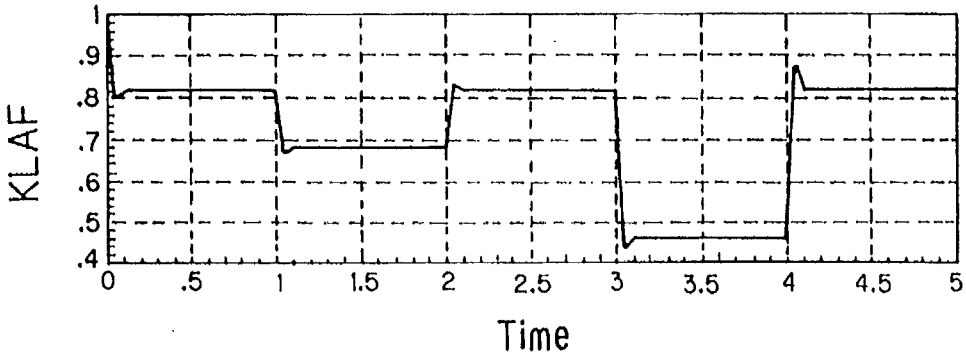

This will be explained with reference to FIG. 30. The air-fuel ratio, x circumflex (k) estimated (by the observer) for the specific cylinder are the results obtained by control using the correction value α(k) for that cycle. Therefore, in calculating the correction value, since the estimated air-fuel ratio is that for a number of times earlier, it is necessary to check what the gain value was at that time. In this sense, and as shown in FIG. 30, the observer output four times earlier (one time earlier, if viewed in terms of the first cylinder) is the estimated first cylinder air-fuel ratio 8 times earlier (the time before last). Thus since the next control gain is calculated from the control gain 8 times earlier and the result (estimated value) obtained by the control using this gain, the timing conforms and convergence on the target value is achieved. FIG. 31 shows the result of this simulation. (It will be noted that control was more stable than in the case of no delay shown at the top of FIG. 31. In this figure, the solid lines show the results for feedback control and the broken lines the results for no feedback control.) FIG. 32 is a block diagram of this model (which is obtained by adding a feedback control system to the model of FIG. 15). FIGS. 33 to 37 show the results of simulation using this model. In will be noted from FIG. 36 that the convergence is markedly better than that in PID control.

Figure 38:
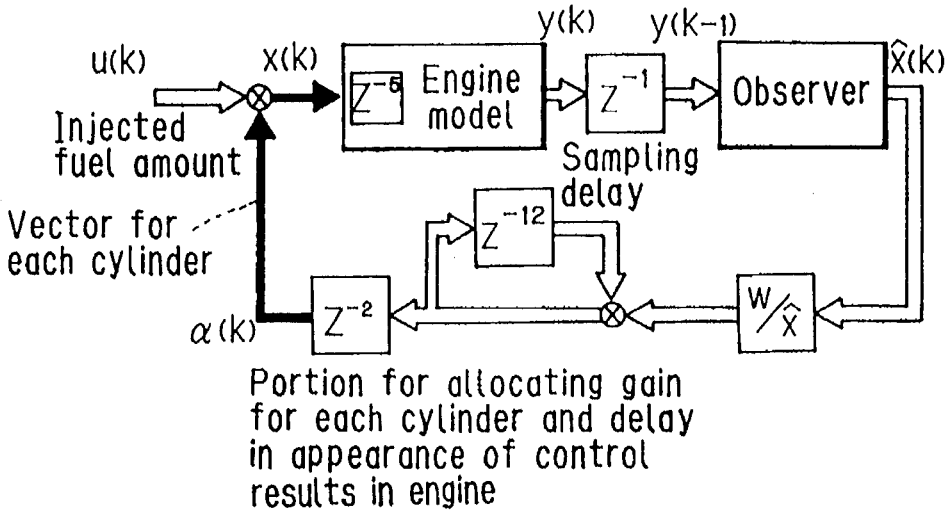
FIG. 38 is a block diagram, similar to FIG. 28, but showing still further modified configuration of the control of FIG. 28.
Figure 39:
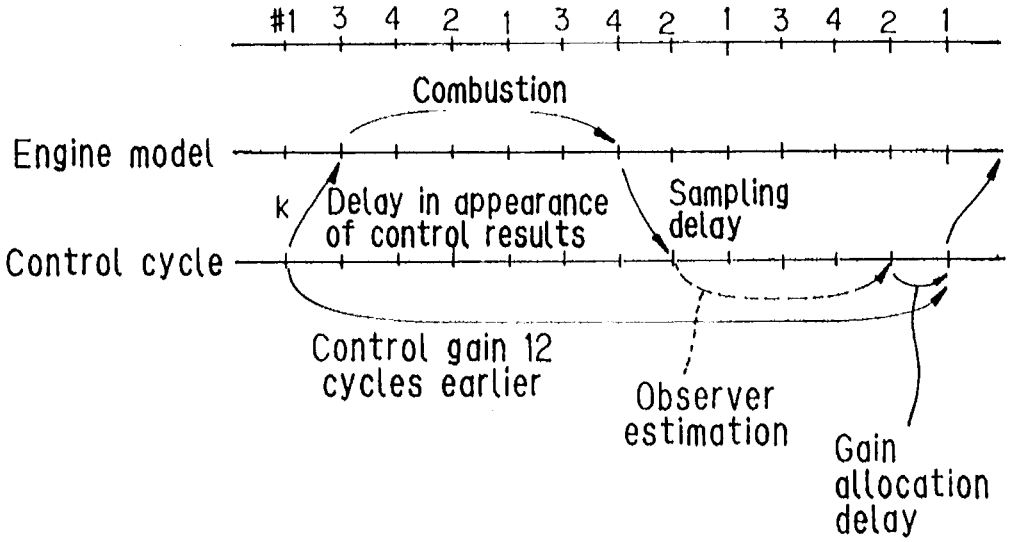
FIG. 39 is a view, similar to FIG. 30, but explaining how to determine the gain of the control of FIG. 38.
Figure 40:
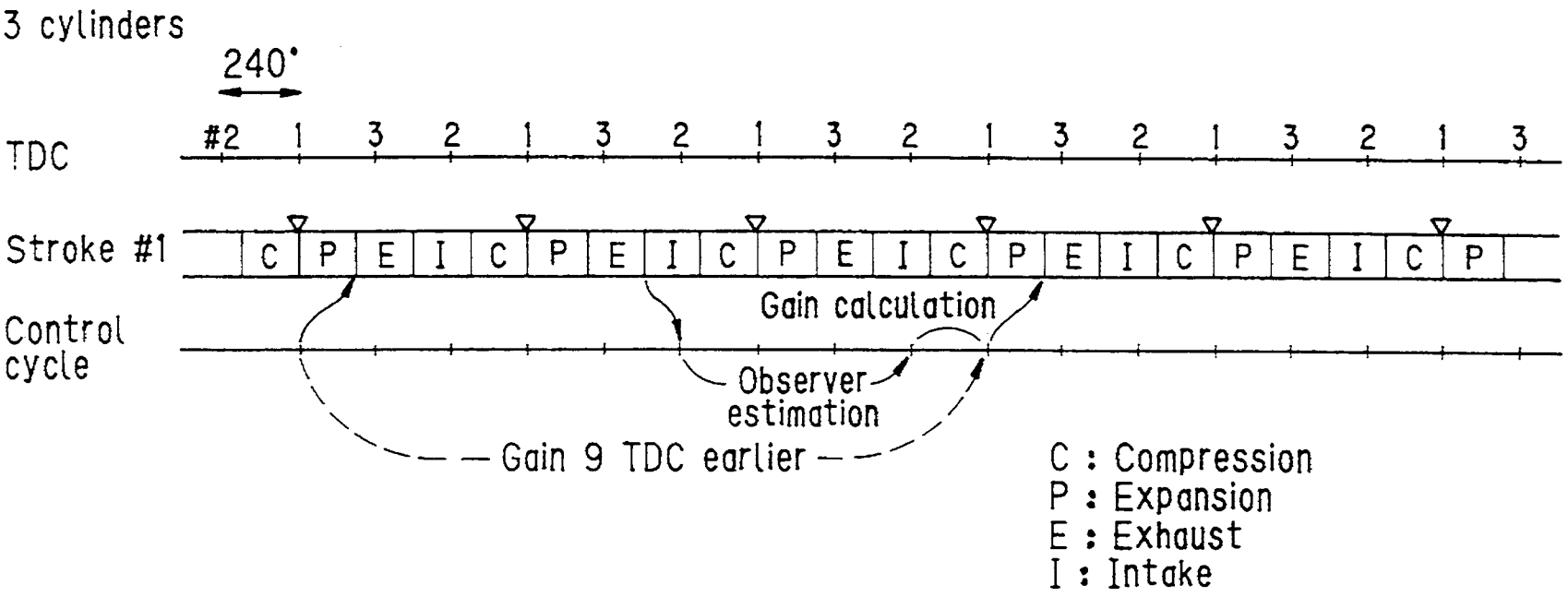
FIGS. 40 to 43 are views explaining the gains to be used for 3, 5, 6 and 12 cylinder engine.
Figure 41:
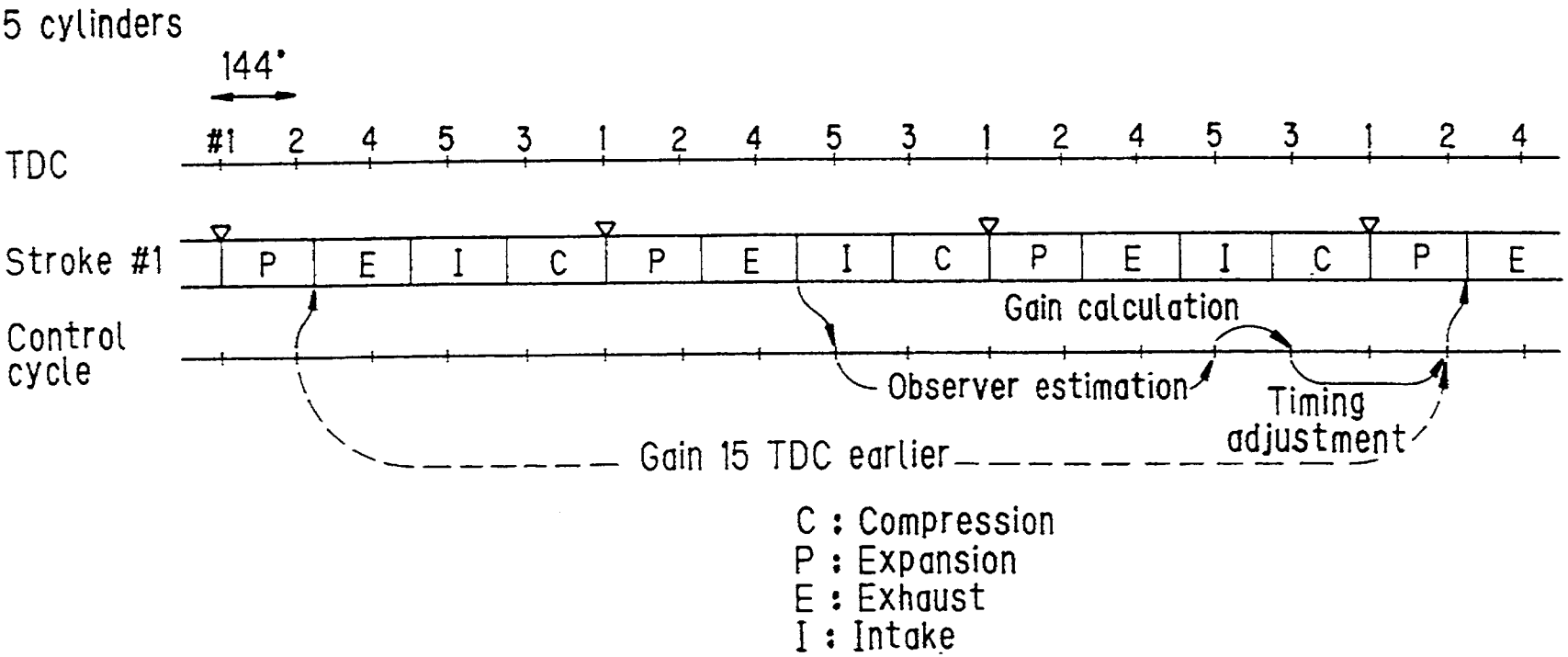
Figure 42:
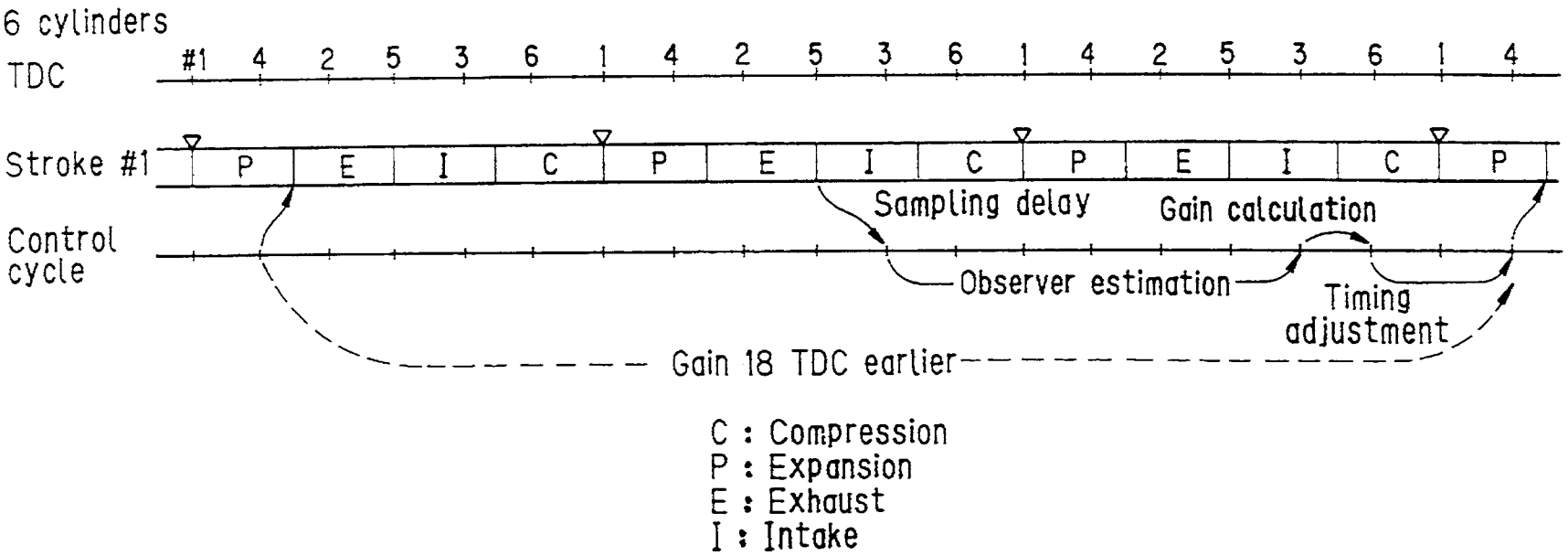
Figure 43:
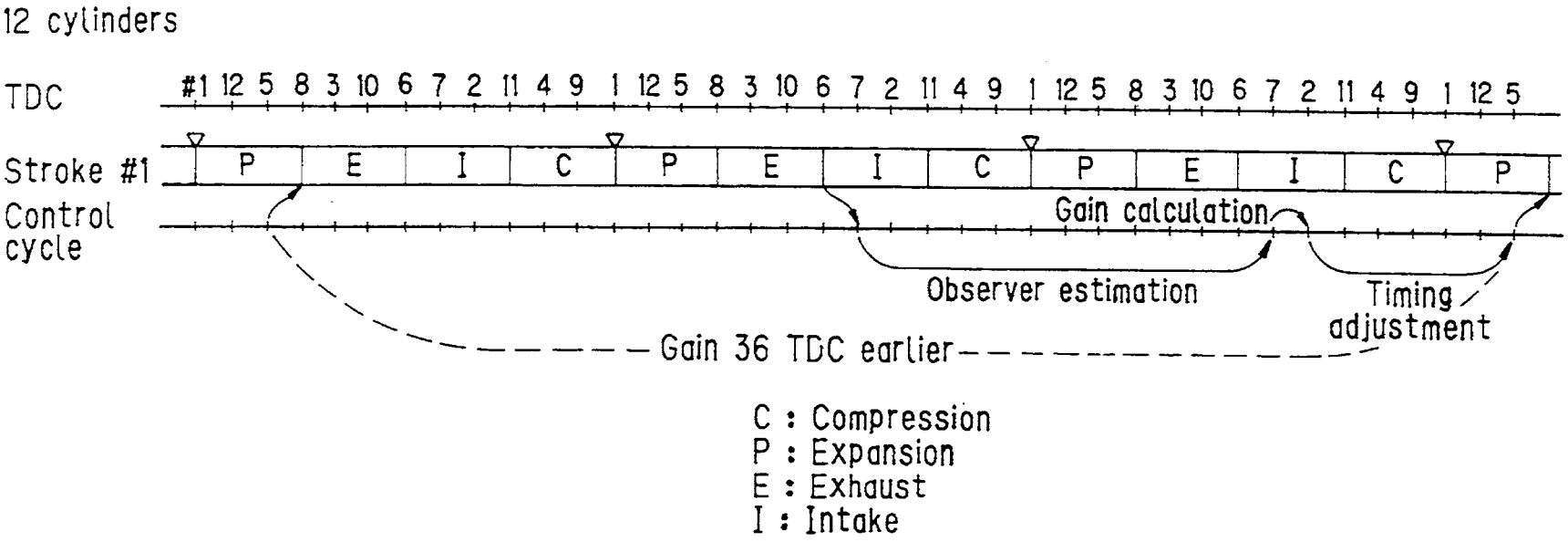

Further study regarding delay led to the conclusion that still better control can be achieved as shown in FIG. 38, namely, by using the control gain 12 times earlier (three times earlier, if viewed in terms of the first cylinder). Specifically, in light of the fact that the delays in the engine, in particular the delay in the appearance of the control results, could be accurately expressed and that the amount of delay contingent on the number of cylinders and the amount of delay contingent on the number of combustion cycles were clarified, it was concluded that, in view of "the delay in the appearance of the control results + the time for one combustion stroke + the sampling delay + the time for observer estimation + the gain allocation," it is preferable to use the gain 12 cycles earlier (three times earlier, if viewed in terms of the first cylinder) as the cumulative gain. This is shown in FIG. 39. For reference, the gains to be used for 3, 5, 6 and 12 cylinder engines are shown in FIGS. 40 to 43.

Next, the feedback control model of FIG. 32 was supplied with ideal input for confirming convergence of the air-fuel ratios of the individual cylinders on the target value. The effect of the observer weighted matrix was also examined.

Figure 44:
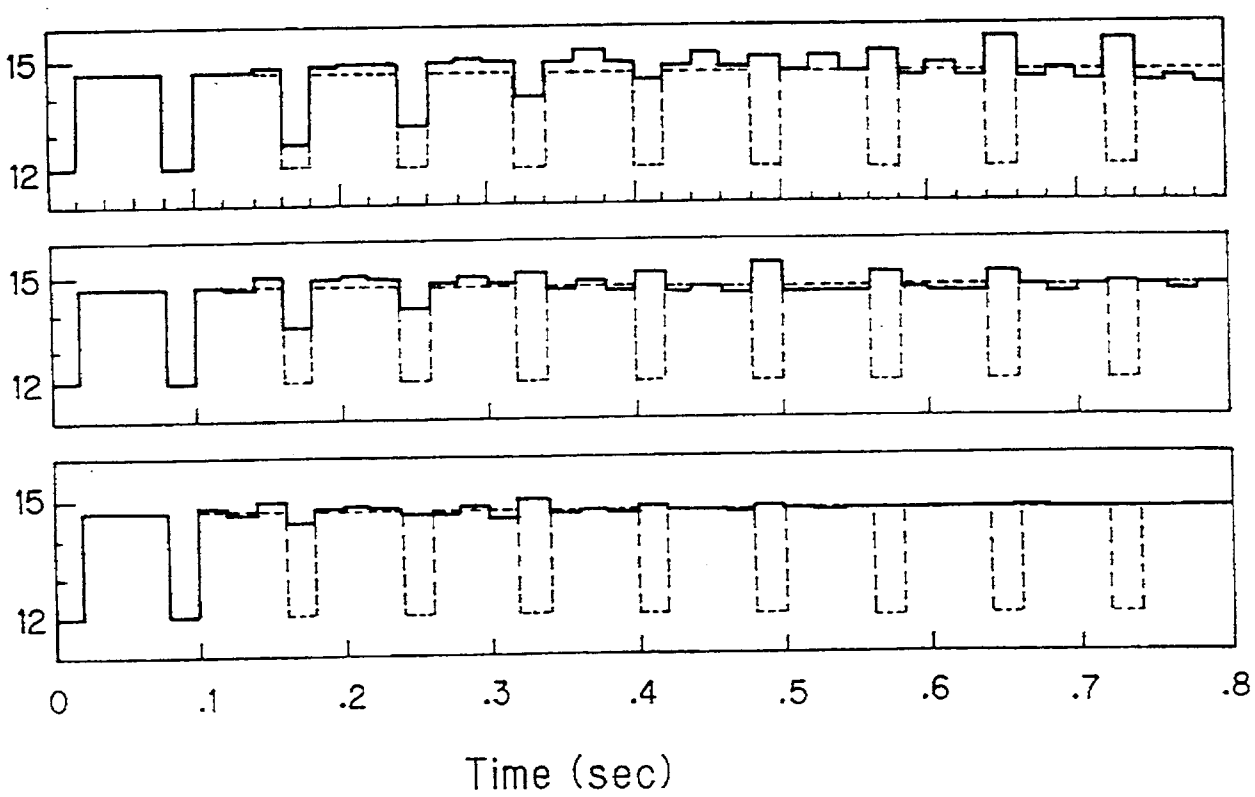
FIG. 44 is a graph of the result of simulation in which the air-fuel ratios are input to the model of FIG. 32.
Figure 45:
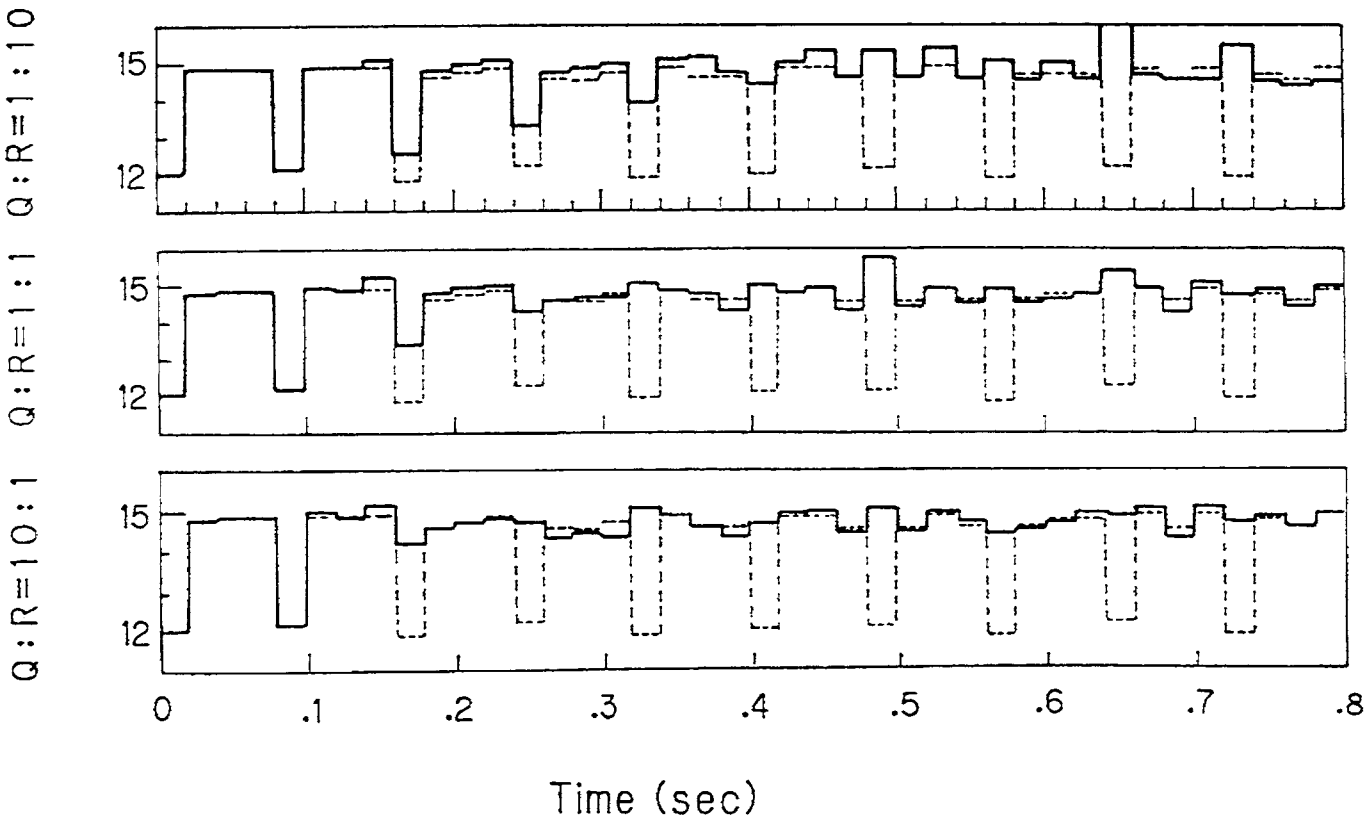
FIG. 45 is the result of another simulation in which the air-fuel ratios with imaginary noise are input to the model of FIG. 32.

The computation results obtained when the individual cylinder air-fuel ratios input to the feedback model of FIG. 32 were 12.0:1, 14.7:1, 14.7:1, 14.7:1 and those obtained when, to simulate imaginary noise, the air-fuel ratios input for the individual cylinders were varied within the ranges of 12.0±0.2:1, 14.7±0.2:1, 14.7± 0.2:1, 14.7± 0.2:1 are shown in FIGS. 44 and 45. In these Figures, (a) to (c) have the following meanings:

(a) Control results when Q member: R member=1:10, (b) Control results when Q member: R member=1:1, (c) Control results when Q member: R member=10:1, where the computation was made for a target air-fuel ratio of 14.7:1 and the members of the observer weighted matrix were such that Q:R= 1:10, 1:1, 10:1. The control error under these conditions is shown in tables of FIG. 46 and 47. As can be seen in FIG. 44, with respect to a fixed ideal input, the rate at which the air-fuel ratios at the individual cylinders converge on the target value increases with increasing observer convergence weight. As shown in FIG. 45, when the air-fuel ratios at the individual cylinders do not stabilize, the convergence deteriorates in proportion as the feedback is late.

From FIG. 28 on, the feedback control was conducted with the input air-fuel ratio for each cylinder multiplied by the control gain. This was only for the purpose of simulation, however, and in actuality the feed back control is conducted as shown in FIG. 22. Namely, the gain is calculated as a multiplication term for the fuel injection period pulse Ti.

While the foregoing embodiment controls the air-fuel ratios at the individual cylinders to the target value on the basis of estimated values of the actual air-fuel ratios at the individual cylinders obtained using only a single air-fuel ratio sensor, the embodiment is not limited to this arrangement and can also be applied to the case where the deadbeat control for achieving the target values is conducted on the basis of the actual air-fuel ratios at the individual cylinders detected using a plurality of air-fuel ratio sensors installed at the individual cylinders.

The present invention has thus been shown and described with reference to the specific embodiments. However, it should be noted that the present invention is in no way limited to the details of the described arrangements, changes and modifications may be made without departing from the scope of the appended claims.

What is claimed is:

1. A fuel control system for controlling an air-fuel ratio mixture of an internal combustion engine, based upon a predetermined estimated air-fuel ratio of an air and fuel mixture supplied to said internal combustion engine calculated from a signal output from an air-fuel ratio sensor installed in an exhaust section of said internal combustion engine, and inclusive of a microprocessor means, said microprocessor means being programmed to operate upon said signal output to:

assume an approximate detection response lag time of aid air-fuel ratio sensor as a first-order lag time system;

produce a state equation from said first-order lag time system;

discretize said state equation for a period Δ to produce a discretized state equation;

calculate a transfer function from said discretized state equation;

calculate an inverse transfer function from said transfer function;

multiply said inverse transfer function by said signal output of said air-fuel ratio sensor to obtain a modified output value therefrom;

determine said predetermined estimated air-fuel ratio of said air and fuel mixture supplied to said internal combustion engine from said modified output value; and utilize said predetermined estimated air-fuel ratio to control each injector solenoid driver of said internal combustion engine to provide an air and fuel mixture representative of said predetermined estimated air-fuel ratio as calculated by said microprocessor means.

2. A system according to claim 1, wherein a current speed of said engine is sensed, and said period delta T is varied with said current engine speed.

3. A system according to claim 1, wherein a current speed of said engine is sensed, and said transfer function has a coefficient which is varied with said current engine speed.

4. A system according to claim 2, wherein said transfer function has a coefficient which is varied with said current engine speed.

5. A system according to claim 1, wherein said engine is a multicylinder engine and said air-fuel ratio sensor is installed at a location at least either at or downstream of a confluence point of said exhaust section from a plurality of said cylinders of said engine.

6. A fuel control system for controlling an air-fuel ratio mixture of a multicylinder internal combustion engine, based upon a predetermined estimated air-fuel ratio of an air and fuel mixture supplied to each cylinder of said multicylinder internal combustion engine calculated from a signal output from an air-fuel ratio sensor installed at a location at least either at or downstream of a confluence point in an exhaust system from a plurality of said cylinders of said multicylinder internal combustion engine, and inclusive of a microprocessor means, said microprocessor means being programmed to operate upon said signal output to:

assume said signal output of said air-fuel ratio sensor is an average value made up of a sum of products of past firing histories of each of said plurality of cylinders weighted by a predetermined value, establish a model using said air-fuel ratios at each said cylinder of said plurality of cylinders as state variables such that said model describes behavior of said exhaust system;

produce a state equation with respect to said state variables;

derive an observer that estimates said state variables and producing an output of said observer;

determine said predetermined estimated air-fuel ratio at each of said plurality of cylinders from said output of said observer; and utilize said predetermined estimated air-fuel ratio to control an injector solenoid driver for each said cylinder of said multicylinder internal combustion engine for controlling said air and fuel mixture to each said cylinder of said plurality of cylinders to provide an air and fuel mixture representative of said predetermined estimated air-fuel ratio as calculated by said microprocessor means.

7. A system according to claim 6, wherein said predetermined value for weighting is varied with an operating condition of said engine.

8. A fuel control system for controlling an air-fuel ratio mixture of a multicylinder internal combustion engine, based upon a predetermined estimated air-fuel ratio of an air and fuel mixture supplied to each cylinder of said multicylinder internal combustion engine calculated from a signal output from an air-fuel ratio sensor installed at a location at least either at or downstream of a confluence point in an exhaust system from a plurality of said cylinders of said multicylinder internal combustion engine and for controlling an air-fuel ratio of said air and fuel mixture at each said cylinder of said plurality of cylinders to a target value of air-fuel ratio, and inclusive of a microprocessor means, said microprocessor means being programmed to operate upon said signal output to:

assume said signal output of said air-fuel ratio sensor is an average value made up of a sum of products of past firing histories of each of said plurality of cylinders weighted by a predetermined value, establish a model using said air-fuel ratios at each said cylinder of said plurality of cylinders as state variables such that said model describes behavior of the exhaust system;

produce a state equation with respect to said state variables;

derive an observer that estimates said state variables and producing an output of said observer;

determine said predetermined estimated air-fuel ratio at each said cylinder of said plurality of cylinders from said output of said observer; and utilize said predetermined estimated air-fuel ratio to control an injector solenoid driver for each said cylinder of said multicylinder internal combustion engine for controlling said air and fuel mixture to each said cylinder of said plurality of cylinders to provide an air-fuel ratio that approximates said target value of air-fuel ratio representative of said predetermined estimated air-fuel ratio as calculated by said microprocessor means.

9. A system according to claim 8, wherein said predetermined value for weighting is varied with an operating condition of said engine.

10. A fuel control system for controlling an air-fuel ratio mixture of a multicylinder internal combustion engine, based upon a predetermined estimated air-fuel ratio of an air and fuel mixture supplied to each cylinder of said multicylinder internal combustion engine calculated from a signal output from an air-fuel ratio sensor installed at a location at least either at or downstream of a confluence point in an exhaust system from a plurality of said cylinders of said multicylinder internal combustion engine and for controlling in discrete-time series said predetermined estimated air-fuel ratio of said air and fuel mixture to a target air-fuel ratio at each cylinder of said plurality of cylinders, and inclusive of a microprocessor means, said microprocessor means being programmed to operate upon said signal output to:

assume said signal output of said air-fuel ratio sensor is an average value made up of a sum of products of past firing histories of each said cylinder of said plurality of cylinders weighted by a predetermined value, establish a model using said air-fuel ratios at each said cylinder of said plurality of cylinders as state variables such that said model describes behavior of said exhaust system;

produce a state equation with respect to said state variables;

derive an observer that estimates said state variables and producing an output of said observer;

determine said predetermined estimated air-fuel ratio at each said cylinder of said plurality of cylinders form said output of said observer;

calculate a ratio between said predetermined estimated air-fuel ratio and said target air-fuel ratio and determine a current correction value by multiplying said calculated ratio by a preceding correction value such that said predetermined estimated air-fuel ratio at each said cylinder of said plurality of cylinders converges on said target air-fuel ratio with a deadbeat response; and utilize said predetermined estimated air-fuel ratio to control an injector solenoid driver for each said cylinder of said multicylinder internal combustion engine for controlling said air and fuel mixture to each said cylinder of said plurality of cylinders to provide an air and fuel mixture representative of said current correction value of said target air-fuel ratio as calculated by said microprocessor means.

11. A system according to claim 10, wherein said preceding correction value is a value at a preceding control cycle earlier by a number corresponding to a multiple of the number of cylinders of the engine.

12. A system according to claim 11, wherein said multiple is a value at least equal to or greater than a three.

13. A fuel control system for controlling air-fuel ratio of a multicylinder internal combustion engine, based upon a predetermined air-fuel ratio of an air and fuel mixture, and inclusive of a microprocessor means, said microprocessor means being programmed to operate upon said signal output to:

determine said predetermined air-fuel ratio at each cylinder of the engine;

calculate a ratio between said predetermined air-fuel ratio and a target air-fuel ratio;

determine a current correction value by multiplying said calculated ratio by a value at a preceding control cycle earlier by a number corresponding to a multiple of said cylinders of the engine such that said predetermined air-fuel ratio at each cylinder converges on said target air-fuel ratio with a deadbeat response; and utilize said predetermined estimated air-fuel ratio to control an injector solenoid driver for each said cylinder of said multicylinder internal combustion engine for controlling said air and fuel mixture to each said cylinder of said multicylinder engine to provide an air and fuel mixture representative of said current correction value of said target air-fuel ratio as calculated by said microprocessor means.

14. A system according to claim 13, wherein said multiple is a value at least equal to or greater than three.

15. A system according to claim 6, wherein said observer has an order which is not less than the number of said plurality of cylinders whose air-fuel ratios are estimated by said air-fuel ratio sensor.

16. A system according to claim 8, wherein said observer has an order which is not less than the number of said plurality of cylinders whose air-fuel ratios are estimated by said air-fuel ratio sensor.

17. A system according to claim 10, wherein said observer has an order which is not less than the number of said plurality of cylinders whose air-fuel ratios are estimated by said air-fuel ratio sensor.

18. A fuel control system for controlling an air-fuel ratio mixture of an internal combustion engine, based upon a predetermined air-fuel ratio of an air and fuel mixture supplied to said internal combustion engine calculated from a signal output from an air-fuel ratio sensor installed in an exhaust system of said internal combustion engine, and inclusive of a microprocessor means, said microprocessor means being programmed to operate upon said signal output to:

assume an approximate detection response lag time of said air-fuel ratio sensor as a first-order lag time system;

calculate a transfer function indicative of na input-output relationship of said first-order lag time system;

calculate an inverse transfer function of said transfer function and multiply said inverse transfer function by said signal output of said air-fuel ratio sensor to obtain an output value;

determine an estimated said predetermined air-fuel ratio of said air and fuel mixture supplied to said engine from said output value; and utilizing said predetermined air-fuel ratio to control each injector solenoid driver of said internal combustion engine to provide air and fuel mixture representative of said predetermined air-fuel ratio as calculated by said microprocessor means.

19. A system according to claim 18, wherein a current speed of said engine is sensed, and said transfer function has a coefficient which is varied with said current engine speed.

20. A fuel control system for controlling an air-fuel ratio mixture of a multicylinder internal combustion engine, based upon a predetermined air-fuel ratio of an air and fuel mixture supplied to each cylinder of said multicylinder internal combustion engine calculated from a signal output from an air-fuel ratio sensor installed at a location at least either at or downstream of a confluence point in an exhaust system from a plurality of cylinders of said multicylinder internal combustion engine, and inclusive of a microprocessor means, said microprocessor means being programmed to operate upon said signal output to:

assume an approximate detection response lag time of said air-fuel ratio sensor as a first-order lag time system;

calculate a transfer function indicative of an input-output relationship of said first-order lag time system;

calculate an inverse transfer function of said transfer function and multiplying said inverse transfer function by said signal output of said air-fuel ratio sensor to obtain an output value;

determine said predetermined estimated air-fuel ratio of said air and fuel mixture supplied to said multicylinder internal combustion engine from said output value;

assume said predetermined estimated air-fuel ratio of said air and fuel mixture is an average value made up of a sum of products of past firing histories of air-fuel ratios of each said cylinder of said plurality of cylinders weighted by a predetermined value, establish a model using said weighted air-fuel ratios as state variables such that said model describes behavior of said exhaust system;

produce a state equation with respect to said state variables;

derive an observer that estimates said state variables and obtaining an output of said observer;

determine said predetermined estimated air-fuel ratio of said air and fuel mixture at each said cylinder from said output of said observer; and utilize said predetermined estimated air-fuel ratio to control an injector solenoid driver for each said cylinder of said multicylinder internal combustion engine for controlling said air and fuel mixture at each said cylinder of said plurality of cylinders representative of said predetermined estimated air-fuel ratio at each said cylinder as calculated by said microprocessor means.

21. A system according to claim 20, wherein said controlling of said air-fuel ratio at each said cylinder is controlled to a target value based on said estimated air-fuel ratio at each said cylinder.

22. A system according to claim 20, wherein said predetermined value for weighting is varied with an operating condition of said engine.

23. A system according to claim 20, wherein said observer has an order which is not less than the number of said plurality of cylinders whose air-fuel ratios are estimated by said air-fuel ratio sensor.

24. A fuel control system for controlling an air-fuel ratio mixture of a multicylinder internal combustion engine, based Upon a predetermined estimated air-fuel ratio of an air and fuel mixture supplied to each cylinder of said multicylinder internal combustion engine calculated from a signal output from an air-fuel ratio sensor installed at a location at least either at or downstream of a confluence point in an exhaust system from a plurality of said cylinders, and inclusive of a microprocessor means, said microprocessor means being programmed to operate upon said signal output to:

derive a behavior of said exhaust system in which X(k) is observed from a state equation and an output equation in which an input U(k) indicates an air-fuel ratio of said air and fuel mixture supplied to each cylinder of said plurality of cylinders and an output Y(k) indicates an air-fuel ratio value by said air-fuel ratio sensor at said confluence point of said exhaust system as $$X(k+1) = AX(k)+BU(k)$$

$$Y(k) = CX(k)+DU(k)$$

where A, B, C and D are coefficients from matrices dependent on the number of said plurality of cylinders, assume said input U(k) as a predetermined value to establish an observer expressed by an equation using said output Y(k) as an input in which a state variable $\hat{X}$ indicates said air-fuel ratio at each cylinder as $$X(k+1) = \hat{X}(k)+Y(k)$$

where K is a gain matrix determine said predetermined estimated air-fuel ratio of said air and fuel mixture being supplied to each cylinder of said plurality of cylinders from said state variable $\hat{X}$, and utilize said predetermined estimated air-fuel ratio to control an injector solenoid driver for each said cylinder of said multicylinder internal combustion engine for controlling said air and fuel mixture supplied to each said cylinder of said plurality of cylinders representative of said predetermined estimated air-fuel ratio supplied to each said cylinder as calculated by said microprocessor means.

25. A fuel control system for controlling an air-fuel ratio mixture of a multicylinder internal combustion engine, based upon a predetermined estimated air-fuel ratio of an air and fuel mixture supplied to each cylinder of said multicylinder internal combustion engine calculated from a signal output from an air-fuel ratio sensor installed at a location at least either at or downstream of a confluence point in an exhaust system from a plurality of said cylinders of said multicylinder internal combustion engine and for controlling an air-fuel ratio of said air and fuel mixture at each said cylinder of said plurality of cylinders to a target value of air-fuel ratio, and inclusive of a microprocessor means, said microprocessor means being programmed to operate upon said signal output to:

derive a behavior of said exhaust system in which X(k) is observed from a state equation and an output equation in which an input U(k) indicates an air-fuel ratio of said air and fuel mixture supplied to each cylinder of said plurality of cylinders and an output Y(k) indicates an air-fuel ratio value by said air-fuel ratio sensor at said confluence point of said exhaust system as $$X(k+1)=AX(k)+BU(k)$$

$$Y(k)=CX(k)+DU(k)$$

where A, B, C and D are coefficients from matrices dependent on the number of said plurality of cylinders, assume said input U(k) as a predetermined value to establish an observer expressed by an equation using said output Y(k) as an input in which a state variable $\hat{X}$ indicates said air-fuel ratio at each cylinder as $$\hat{X}(k+1)=\hat{X}(k)+Y(k)$$

wherein K is a gain matrix determine said predetermined estimated air-fuel ratio of said air and fuel mixture being supplied to each said cylinder of said plurality of cylinders from said state variable $\hat{X}$, and utilize said predetermined estimated air-fuel ratio to control an injector solenoid driver for each said cylinder of said multicylinder internal combustion engine for controlling said air and fuel mixture to each said cylinder of said plurality of cylinders to provide an air-fuel ratio that approximates said target value of air-fuel ratio representative of said predetermined estimated air-fuel ratio supplied to each said cylinder as calculated by said microprocessor means.

26. A fuel control system for controlling an air-fuel ratio mixture of a multicylinder internal combustion engine, based upon a predetermined estimated air-fuel ratio of an air and fuel mixture supplied to each cylinder of said multicylinder internal combustion engine calculated from a signal output from an air-fuel ratio sensor installed at a location at least either at or downstream of a confluence point in an exhaust system from a plurality of said cylinders and for controlling in discrete-time series said predetermined estimated air-fuel ratio of said air and fuel mixture to a target air-fuel ratio at each said cylinder of said plurality of cylinders, and inclusive of a microprocessor means, said microprocessor means being programmed to operate upon said signal output to:

derive a behavior of said exhaust system in which X(k) is observed from a state equation and an output equation in which an input U(k) indicates an air-fuel ratio of said air and fuel mixture supplied to each cylinder of said plurality of cylinders and an output Y(k) indicates an air-fuel ratio value by said air-fuel ratio sensor at said confluence point of said exhaust system as $$X(k+1)=AX(k)+BU(k)$$

$$Y(k)=CX(k)+DU(k)$$

where A, B,C and D are coefficients from matrices dependent on the number of said plurality of cylinders, assume said input U(k) as a predetermined value to establish an observer expressed by an equation using said output Y(k) as an input in which a state variable $\hat{X}$ indicates said air-fuel ratio at each cylinder as $$\hat{X}(k+1)=\hat{X}X(k)+Y(k)$$

wherein K is a gain matrix determine said predetermined estimated air-fuel ratio of said air and fuel mixture being supplied to each said cylinder of said plurality of cylinders from said state variables $\hat{X}$, calculate a ratio between said predetermined estimated air-fuel ratio and said target air-fuel ratio and determine a current correction value by multiplying said calculated ratio by a preceding correction value such that said predetermined estimated air-fuel ratio at each said cylinder of said plurality of cylinders converges on said target air-fuel ratio with a deadbeat response; and utilize said predetermined estimated air-fuel ratio to control an injector solenoid driver for each said cylinder of said multicylinder internal combustion engine for controlling said air and fuel mixture supplied to each said cylinder of said plurality of cylinders to provide an air and fuel mixture representative of said current correction value of aid target air-fuel ratio as calculated by said microprocessor means.

27. A fuel control system for controlling an air-fuel ratio mixture of a multicylinder internal combustion engine, based upon a predetermined estimated air-fuel ratio of an air and fuel mixture supplied to each cylinder of said multicylinder internal combustion engine calculated from a signal output from an air-fuel ratio sensor installed at a location at least either at or downstream of a confluence point in an exhaust system from a plurality of said cylinders, and inclusive of a microprocessor means, said microprocessor means being programmed to operate upon said signal output to:

assume an approximate detection response lag time of said air-fuel ratio sensor as a first-order lag system;

calculate a transfer function indicative of an input-output relationship of said first-order lag system;

calculate an inverse transfer function of said transfer function and multiply said inverse transfer function by said signal output of said air-fuel ratio sensor to obtain an output value;

determine said predetermined estimated air-fuel ratio of said air and fuel mixture supplied to said multicylinder internal combustion engine from said output value;

derive a behavior of said exhaust system in which X(k) is observed from a state equation and an output equation in which an input U(k) indicates an air-fuel ratio of said air and fuel mixture supplied to each said cylinder of said plurality of cylinders and an output Y(k) indicates an air-fuel ratio value by said air-fuel ratio sensor at said confluence point of said exhaust system as $$X(k+1)=AX(k)+BU(k)$$

$$Y(k)=CX(k)+DU(k)$$

where A, B, C and D are coefficients from matrices dependent on the number of said plurality of cylinders, assume said input U(k) as a predetermined value to establish an observer expressed by an equation using said output Y(k) as an input in which a state variable $\hat{X}$ indicates said air-fuel ratio at each cylinder as $$\hat{X}(k+1)=\hat{X}(k)+Y(k)$$

wherein K is a gain matrix determine said predetermined estimated air-fuel ratio of said air and fuel mixture being supplied to each said cylinder of said plurality of cylinders from said state variable $\hat{X}$, and utilize said predetermined estimated air-fuel ratio to control an injector solenoid driver for each said cylinder of said multicylinder internal combustion engine for controlling said air and fuel mixture supplied to each said cylinder of said plurality of cylinders to provide an air and fuel mixture representative of said predetermined estimated air-fuel ratio supplied to each said cylinder as calculated by said microprocessor means.

* * * * *

UNITED STATES PATENT AND TRADEMARK OFFICE

CERTIFICATE OF CORRECTION

PATENT NO. : 5,524,598

DATED : June 11, 1996

INVENTOR(S) : Hasegawa et al.

It is certified that error appears in the above-indentified patent and that said Letters Patent is hereby corrected as shown below:

In the Drawings:

Fig. 29, delete "cntrol result" and insert -- control result --.

Column 14, line 8, delete "aid" and insert -- said --.

Column 14, line 12, after "period" delete "Δ" and insert -- ΔT --.

Column 14, line 32, delete " delta" and insert -- Δ --.

Column 18, third equation, delete "$X(k+1)=\hat{X}(k)+Y(k)$" and substitute -- $X(k+1)=(A-KC)\hat{X}(k)+Y(k)$ --

Column 19, third equation, delete "$\hat{X}(k+1)=\hat{X}(k)+Y(k)$" and substitute -- $\hat{X}(k+1)=(A-KC)\hat{X}(k)+Y(k)$ --.

Column 20, third equation, delete "$\hat{X}(k+1)=\hat{X}X(k)+Y(k)$" and substitute -- $\hat{X}(k+1)=(A-KC)\hat{X}(k)+Y(k)$ --.

UNITED STATES PATENT AND TRADEMARK OFFICE

CERTIFICATE OF CORRECTION

PATENT NO. : 5,524,598

DATED : June 11, 1996

INVENTOR(S) : Hasegawa et al.

It is certified that error appears in the above-indentified patent and that said Letters Patent is hereby corrected as shown below:

Column 22, the equation, delete "$\hat{X}(k+1)=\hat{X}(k)+Y(k)$" and substitute -- $\hat{X}(k+1)=(A-KC)\hat{X}(k)+Y(k)$ --.

Signed and Sealed this

Twelfth Day of November, 1996

Bruce Lehman

*Attest:*

BRUCE LEHMAN

*Attesting Officer*

*Commissioner of Patents and Trademarks*